US009857737B2

(12) United States Patent
Unagida et al.

(10) Patent No.: US 9,857,737 B2
(45) Date of Patent: Jan. 2, 2018

(54) IMAGE FORMING APPARATUS

(71) Applicant: FUJI XEROX CO., LTD., Tokyo (JP)

(72) Inventors: Yasunori Unagida, Kanagawa (JP); Yu Tsuda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/042,190

(22) Filed: Feb. 12, 2016

(65) Prior Publication Data

US 2017/0060047 A1 Mar. 2, 2017

(30) Foreign Application Priority Data

Aug. 24, 2015 (JP) ..... 2015-164802

(51) Int. Cl.

| | |
|---|---|
| ***G03G 15/20*** | (2006.01) |
| ***G03G 15/01*** | (2006.01) |
| ***G03G 15/00*** | (2006.01) |
| ***G03G 15/23*** | (2006.01) |

(52) U.S. Cl.

CPC ..... *G03G 15/2014* (2013.01); *G03G 15/0105* (2013.01); *G03G 15/234* (2013.01); *G03G 15/6585* (2013.01); *G03G 15/2064* (2013.01); *G03G 2215/209* (2013.01); *G03G 2215/2032* (2013.01)

(58) Field of Classification Search

CPC ..... G03G 15/6585; G03G 2215/00417; G03G 2215/0043; G03G 2215/00434; G03G 2215/00438; G03G 2215/209; G03G 2215/00421

USPC ..... 399/321

See application file for complete search history.

(56) References Cited

U.S. PATENT DOCUMENTS

| | | | | |
|---|---|---|---|---|
| 9,291,959 | B1 * | 3/2016 | Sawai | G03G 15/2046 |
| 2006/0127143 | A1 * | 6/2006 | Tamura | G03G 15/2021 399/329 |
| 2014/0029966 | A1 * | 1/2014 | Kojiri | G03G 13/22 399/67 |
| 2014/0093267 | A1 * | 4/2014 | Kubo | G03G 15/0194 399/69 |
| 2014/0356008 | A1 * | 12/2014 | Harashima | G03G 13/20 399/69 |
| 2014/0356035 | A1 | 12/2014 | Harashima et al. | |

(Continued)

FOREIGN PATENT DOCUMENTS

JP 2014-235381 A 12/2014

*Primary Examiner* — Carla Therrien

(74) *Attorney, Agent, or Firm* — Sughrue Mion, PLLC

(57) ABSTRACT

An image forming apparatus includes an image forming unit that forms a first image and a second image and transfers the first and second images to a recording medium, the first image including a metallic color image, the second image not including the metallic color image; and a fixing unit that fixes the first image and the second image to the recording medium. The image forming apparatus has a mode in which, when forming the first image on only one of a first surface and a second surface of the recording medium, the image forming unit transfers the first image to the first surface of the recording medium and the fixing unit fixes the first image to the first surface, and subsequently the image forming unit transfers the second image to the second surface of the recording medium and the fixing unit fixes the second image to the second surface.

13 Claims, 21 Drawing Sheets

(56) References Cited

U.S. PATENT DOCUMENTS

2015/0168884 A1* 6/2015 Kakishima ..... G03G 15/2039
399/67
2016/0011545 A1* 1/2016 Kakishima ..... G03G 15/20
399/82

* cited by examiner

IMAGE FORMING APPARATUS

CROSS-REFERENCE TO RELATED APPLICATIONS

This application is based on and claims priority under 35 USC 119 from Japanese Patent Application No. 2015-164802 filed Aug. 24, 2015.

BACKGROUND (i) Technical Field

The present invention relates to an image forming apparatus.

(ii) Related Art

A toner including a flat pigment may be used to form an image having a metallic gloss. If flat surfaces of particles of the pigment extend substantially parallel to a surface of a recording medium, the metallic gloss is improved as compared with a case where the flat surfaces do not extend substantially parallel to the surface.

In duplex printing, that is, when forming images on both surfaces of a recording medium, an image that is first formed on a first surface of the recording medium passes through a fixing unit twice, and an image that is subsequently formed on a second surface of the recording medium passes through the fixing unit once. Thus, a binder resin of a toner in the image on the first surface, which passes through the fixing unit twice, becomes softer than that in the image on the second surface, which passes through the fixing unit once. As a result, flat surfaces of a pigment of the image on the first surface becomes closer to parallel to the surface of the recording medium, and the image on the first surface has a higher metallic gloss.

SUMMARY

According to an aspect of the present invention, an image forming apparatus includes an image forming unit that forms a first image and a second image and transfers the first image and the second image to a recording medium, the first image including a metallic color image formed by using a metallic color toner including a flat metallic pigment, the second image not including the metallic color image; and a fixing unit that fixes the first image and the second image, which have been transferred to the recording medium, to the recording medium by heating the first image and the second image. The image forming apparatus has a mode in which, when forming the first image on only one of a first surface and a second surface of the recording medium, the image forming unit transfers the first image to the first surface of the recording medium and the fixing unit fixes the first image to the first surface, and subsequently the image forming unit transfers the second image to the second surface of the recording medium and the fixing unit fixes the second image to the second surface.

BRIEF DESCRIPTION OF THE DRAWINGS

An exemplary embodiment of the present invention will be described in detail based on the following figures, wherein.

DETAILED DESCRIPTION

Referring to FIGS. 1 to 19B, an image forming apparatus according to an exemplary embodiment of the present invention will be described. In each figure, an arrow H indicates the up-down direction of the apparatus (the vertical direction), and an arrow W indicates the width direction of the apparatus (a horizontal direction).

Overall Structure of Image Forming Apparatus

Figure 1:
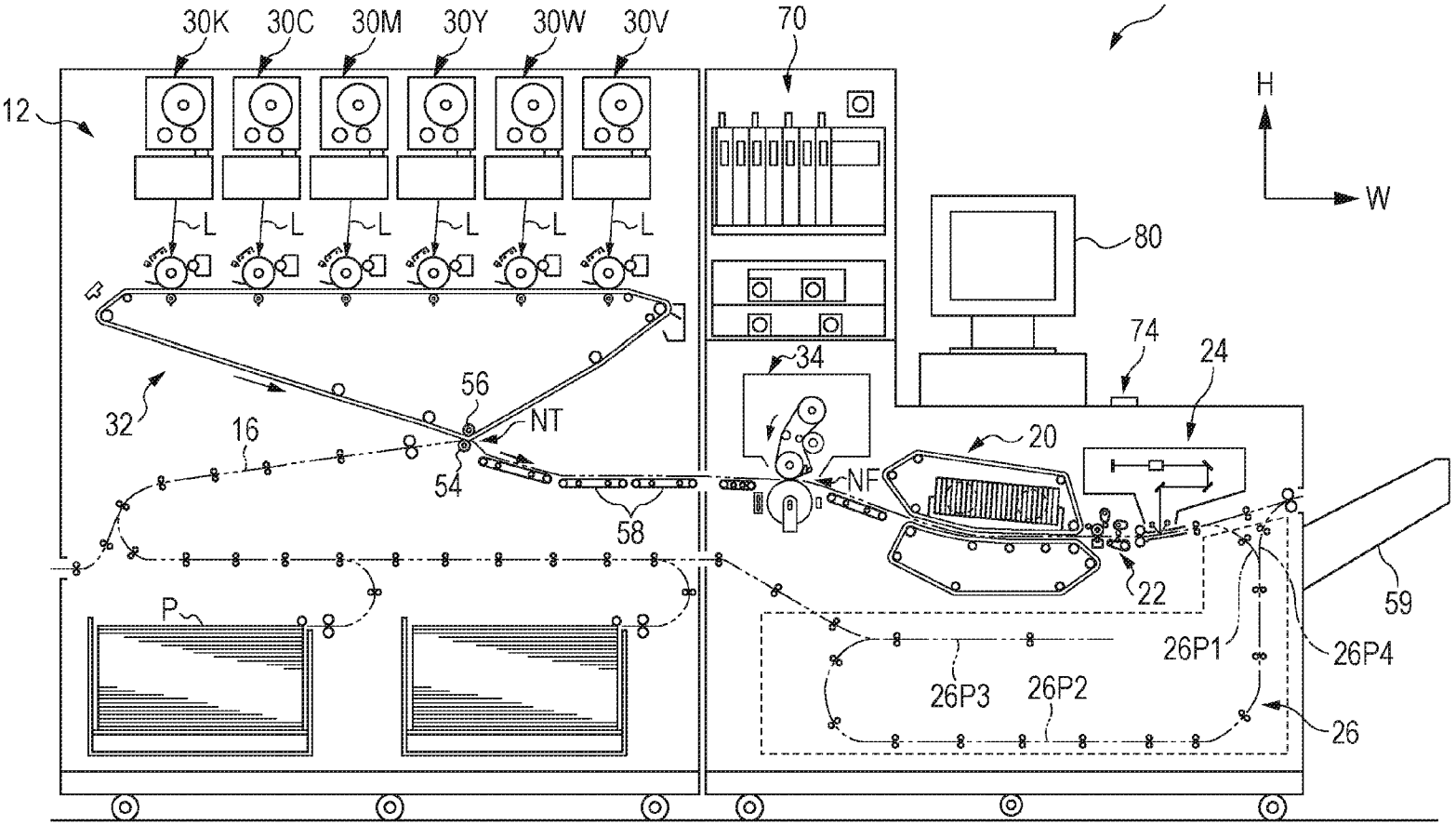
FIG. 1 is a schematic view illustrating an image forming apparatus according to an exemplary embodiment of the present invention.

As illustrated in FIG. 1, an image forming apparatus 10 includes an image forming unit 12. The image forming unit 12 forms an image on a sheet P (which is an example of a recording medium), which is transported along a transport path 16, by using an electrophotographic method.

The image forming apparatus 10 includes a controller 70, an operation unit 80, a cooling unit 20, a correction unit 22, and an image inspection unit 24. The controller 70 controls operations of components of the image forming apparatus 10. The operation unit 80 allows a user to perform various operations. The cooling unit 20 cools a sheet P on which a toner image is formed. The correction unit 22 corrects curl of the sheet P. The image inspection unit 24 inspects an image formed on the sheet P.

The image forming apparatus 10 further includes a reverse path 26, which enables the image forming apparatus 10 to form images on both surfaces of the sheet P (to perform duplex printing). The reverse path 26 reverses the sheep P, on which an image has been formed on a front surface thereof, and transports the sheet P toward the image forming unit 12 again.

With the image forming apparatus 10 structured as described above, the image forming unit 12 forms an image on a front surface of the sheet P transported along the transport path 16. After an image has been formed on the sheet P, the sheet P passes through the cooling unit 20, the correction unit 22, and the image inspection unit 24, and is output from the apparatus.

When forming an image on a back surface of the sheet P, the sheet P, on the front surface of which an image has been formed, is transported along the reverse path 26 and the image forming unit 12 forms an image on a back surface of the sheet P.

Image Forming Unit

Figure 2:
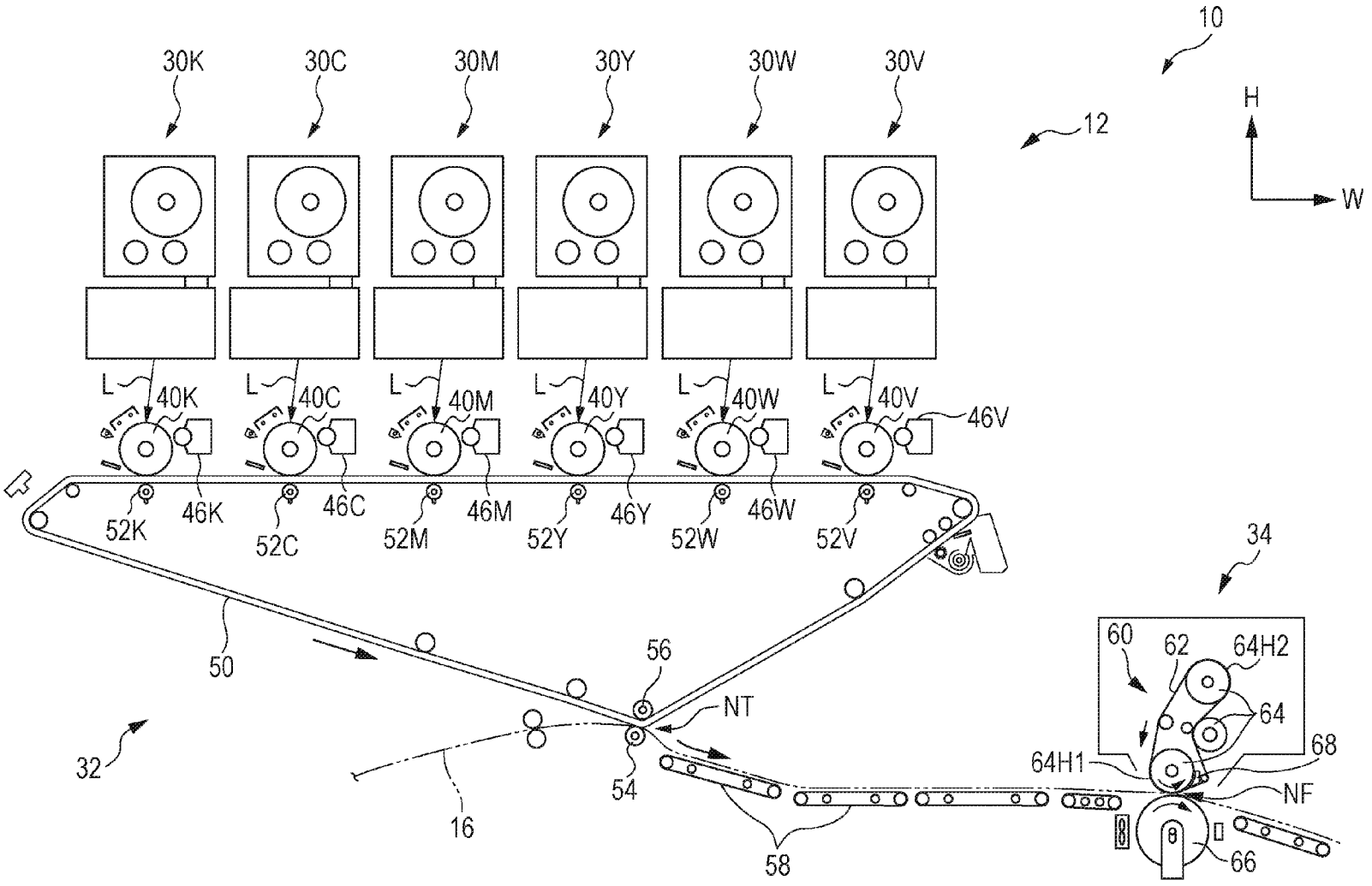
FIG. 2 illustrates the structure of an image forming unit of the image forming apparatus according to the exemplary embodiment of the present invention.

As illustrated in FIG. 2, the image forming unit 12 includes plural toner image forming units 30, a transfer unit 32, and a fixing unit 34. The toner image forming units 30 form toner images of different colors. The transfer unit 32 transfers the toner images, formed by the toner image forming units 30, to the sheet P. The fixing unit 34 fixes the toner images, transferred by the transfer unit 32, to the sheet P.

Toner Image Forming Unit

The toner image forming units 30 form toner images of corresponding colors. In the present exemplary embodiment, six toner image forming units 30 respectively form a first specific color (V) toner image, a second specific color (W) toner image, a yellow (Y) toner image, a magenta (M) toner image, a cyan (C) toner image, and a black (K) toner image.

In FIG. 2 and other figures, the symbols (V), (W), (Y), (M), (C), and (K) respectively denote the aforementioned colors. The first specific color (V) is a metallic color, which is silver in the present exemplary embodiment. A metallic color toner including a flat metallic pigment 110 (see FIGS. 6A and 6B) is used for the first specific color (V). The second specific color (W) is a user-specific corporate color, which is more frequently used than other colors. The details of the metallic color toner, that is, the silver toner, and how the controller 70 controls components of the image forming apparatus 10 when forming an image by using the silver toner will be described below.

In the following description, unless it is necessary to differentiate between the first specific color (V), the second specific color (W), the yellow (Y), the magenta (M), the cyan (C), and the black (K), the characters V, W, Y, M, C, and K will be omitted from reference numerals.

Figure 3:
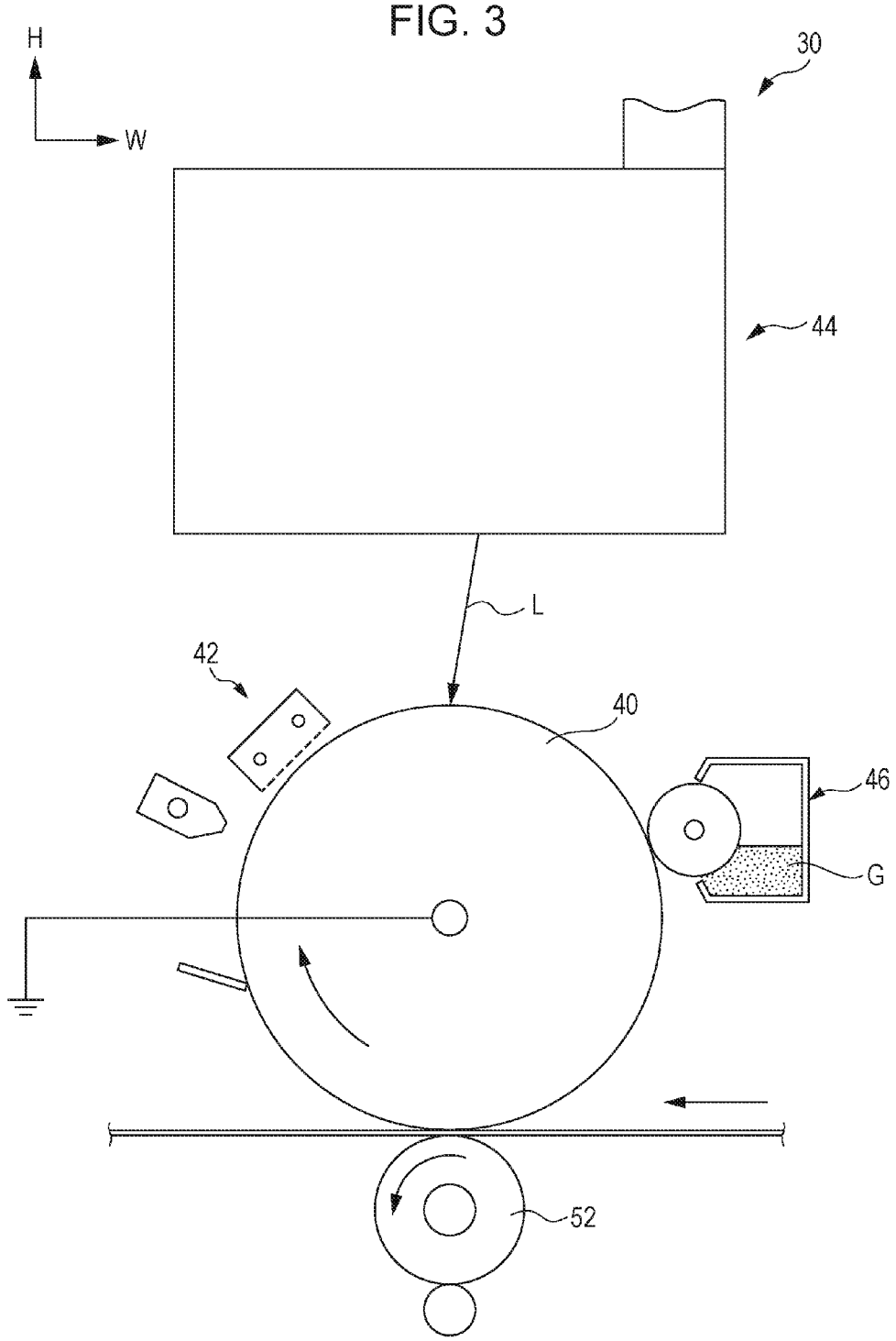
FIG. 3 illustrates the structure of a toner image forming unit of an image forming apparatus according to the exemplary embodiment of the present invention.

The toner image forming units 30 have the same structure except for toners that they use. As illustrated in FIG. 3, each toner image forming unit 30 includes a photoconductor drum 40, a charger 42, an exposure device 44, and a developing device 46. The photoconductor drum 40, which rotates, is an example of a photoconductor drum. The charger 42 charges the photoconductor drum 40. The exposure device 44 irradiates the charged photoconductor drum 40 with exposure light to form an electrostatic latent image. The developing device 46 develops the electrostatic latent image into a toner image by using a developer G including a toner.

As illustrated in FIG. 2, the photoconductor drums 40 are in contact with a transfer belt 50 (described in detail below), which rotates. The toner image forming units 30 for the first specific color (V), the second specific color (W), yellow (Y), magenta (M), cyan (C), and black (K) are arranged in this order from upstream in the direction in which the transfer belt 50 rotates (indicated by an arrow in FIG. 2). Each of the toner image forming units 30 forms a toner image of a corresponding color by using a toner of the color.

Transfer Unit

As illustrated in FIG. 2, the transfer unit 32 includes the transfer belt 50 and first-transfer rollers 52. The transfer belt 50 is looped over plural rollers (with no reference numerals) and rotates in the direction of an arrow in FIG. 2. The first-transfer rollers 52 transfer the color toner images, formed on the photoconductor drums 40, to the transfer belt 50.

The first-transfer rollers 52 are disposed opposite the photoconductor drums 40 with the transfer belt 50 therebetween. A power supply (not shown) applies a transfer bias voltage (in the present exemplary embodiment, positive voltage), whose polarity is opposite to that of toners (in the present exemplary embodiment, negative polarity), to the first-transfer rollers 52. Due to application of the transfer bias voltage, transfer electric currents flow between the first-transfer rollers 52 and the photoconductor drums 40, and thereby the toner images formed on the photoconductor drums 40 are transferred to the transfer belt 50.

The transfer unit 32 further includes a roller 56 and a second-transfer roller 54. The transfer belt 50 is looped over the roller 56. The second-transfer roller 54 is disposed opposite the roller 56 with the transfer belt 50 therebetween and transfers the toner images, transferred to the transfer belt 50, to the sheet P. Thus, a transfer nip NT, in which the toner images are transferred to the sheet P, is formed between the second-transfer roller 54 and the transfer belt 50.

A power supply (not shown) applies a transfer bias voltage (positive voltage), whose polarity is opposite to that of toners, to the second-transfer roller 54. Due to application of the transfer bias voltage, a transfer electric current flows between the second-transfer roller 54 and the roller 56, and thereby the toner images are transferred from the transfer belt 50 to the sheet P (formed on the sheet P) passing through the transfer nip NT.

With this structure, the first-transfer rollers 52 respectively first-transfer a first specific color (V) toner image, a second specific color (W) toner image, a yellow (Y) toner image, a magenta (M) toner image, a cyan (C) toner image, and a black (K) toner image from the transfer belt 50 in an overlapping manner. The second-transfer roller 54 second-transfers the overlapping toner images to the sheet P passing through the transfer nip NT.

Fixing Unit

As illustrated in FIG. 2, the fixing unit 34 includes a fixing module 60 and a pressing roller 66. The fixing module 60 includes an endless fixing belt 62. The pressing roller 66 contacts the fixing module 60 and presses the fixing module 60. A fixing nip NF, at which the fixing belt 62 and the pressing roller 66 contact each other, is formed between the fixing belt 62 and the pressing roller 66.

The fixing module 60 includes the fixing belt 62, plural rollers 64 of different sizes, and a separation pad 68. The fixing belt 62 is looped over the rollers 64. The separation pad 68 separates the sheet P from the fixing belt 62. The rollers 64 include a roller 64H1 and a roller 64H2, each of which has a heater therein. The roller 64H1 is disposed opposite the pressing roller 66 with the fixing belt 62 therebetween. The roller 64H1 is rotated in the direction of an arrow in FIG. 2.

The pressing roller 66 is rotated in the direction of an arrow in FIG. 2 at the same peripheral velocity as the fixing belt 62.

Reverse Path

As illustrated in FIG. 1, the reverse path 26 allows a sheet P, which has passed through the image inspection unit 24, to be transported thereinto. The reverse path 26 includes a branch path 26P1, a transport path 26P2, a reverse path 26P3, and a branch reverse path 26P4.

The branch path 26P1 branches off from the transport path 16. The transport path 26P2 transports a sheet P, received from the branch path 26P1, to the reverse path 26P3 or changes the transport direction of the sheet P to the opposite direction and transports the sheet P to the branch reverse path 26P4.

The reverse path 26P3 reverses the sheet P by changing the transport direction of the sheet P to the opposite direction and transports the sheet P to the transport path 16, which is upstream of the transfer nip NT in the transport direction of the sheet P.

The branch reverse path 26P4 outputs the sheet P, which has been reversed by being transported in the opposite direction in the transport path 26P2, to an output unit 59.

In simplex printing, an image is formed on a first surface of the sheet P. In duplex printing, images are formed on a first surface and a second surface (a front surface and a back surface) of the sheet P. In duplex printing, an image is formed on a first surface (front surface) of the sheet P, the sheet P is reversed by being transported along the reverse path 26, the sheet P is transported back to the image forming unit 12, and the image forming unit 12 forms an image on a second surface (back surface) of the sheet P.

Reverse Output

In simplex printing, a sheet P is output so that a surface of the sheet P on which an image is formed faces upward. In duplex printing, a sheet P is output so that a surface of the sheet P on which an image is subsequently formed faces upward.

However, the image forming apparatus 10 according to the present exemplary embodiment has a reverse mode that allows a user to select which of the surfaces of the sheet P faces upward when the sheet P is output. In other words, in simplex printing, it is possible to output the sheet P so that a surface of the sheet P on which an image is formed faces downward; and, in duplex printing, it is possible to output the sheet P so that a surface of the sheet P on which an image is subsequently formed faces downward.

Figure 4A:
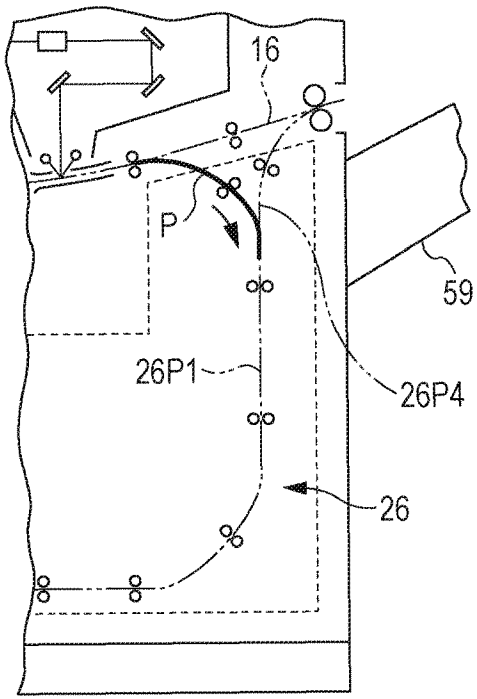
FIGS. 4A to 4C illustrate a process through which the image forming apparatus according to the exemplary embodiment of the present invention reverses a sheet and outputs the sheet.
Figure 4B:
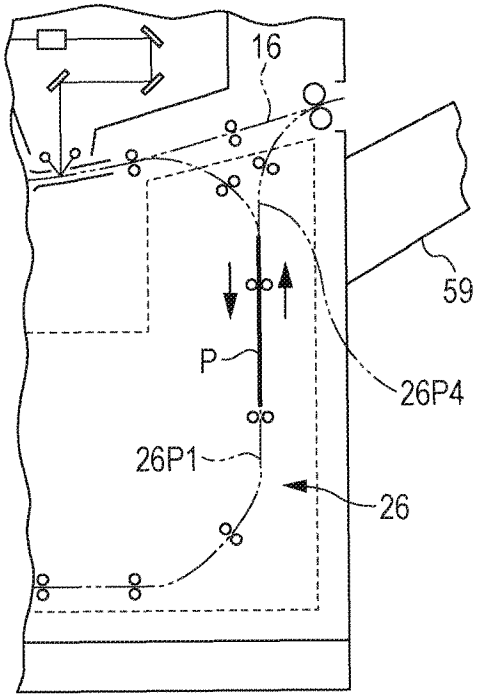
Figure 4C:
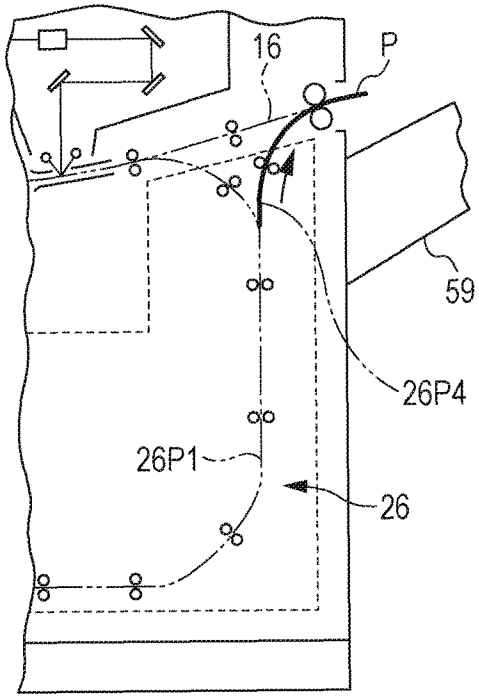

To be specific, as illustrated in FIGS. 4A to 4C, it is possible to reverse the sheet P by transporting the sheet P, on the front and back surfaces of which images have been formed, into the branch path 26P1 of the reverse path 26, changing the transport direction, transporting the sheet P through the branch reverse path 26P4, and outputting the sheet P to the output unit 59.

Image Forming Operation

Next, an image forming process through which the image forming apparatus 10 forms an image on the sheet P and a post-processing process will be described.

Referring to FIG. 1, when the controller 70 of the image forming apparatus 10 receives an instruction to form an image, the controller 70 activates the toner image forming units 30 and other components.

Referring to FIG. 3, each of the chargers 42 charges a corresponding one of the photoconductor drums 40. The controller 70 (see FIG. 1) sends image data, which has been processed by an image signal processor, to the exposure devices 44. The exposure devices 44 emit exposure light L in accordance with image data and expose the charged photoconductor drums 40 to light. Thus, electrostatic latent images are formed on the outer peripheral surfaces of the photoconductor drums 40. The developing devices 46 develop the electrostatic latent images formed on the photoconductor drums 40. A first specific color (V) toner image, a second specific color (W) toner image, a yellow (Y) toner image, a magenta (M) toner image, a cyan (C) toner image, and a black (K) toner image are respectively formed on the photoconductor drums 40 shown in FIG. 2.

Referring to FIG. 2, the first-transfer rollers 52 successively first-transfer the color toner images, which have been formed on the photoconductor drums 40, to the rotating transfer belt 50 at first-transfer positions. Thus, an overlapping toner image, in which six color toner images overlap, is formed on the transfer belt 50. As the transfer belt 50 rotates, the overlapping toner image is transported to the second-transfer position NT. The sheet P is supplied to the second-transfer position NT at the same timing as the overlapping toner image is transported to the second-transfer position NT. The overlapping toner image is second-transferred from the transfer belt 50 to the recording medium P at the second-transfer position NT.

The sheet P, to which the toner image has been second-transferred, is transported by transport belts 58 toward the fixing unit 34 while being sucked on the transport belts 58 by a negative pressure. The fixing unit 34 applies heat and pressure to the sheet P passing through the fixing nip NF. Thus, the toner image, transferred to the sheet P, is fixed to the sheet P.

As illustrated in FIG. 1, the cooling unit 20 cools the sheet P, which has passed through the fixing unit 34. Then, the correction unit 22 corrects curl of the sheet P. Further, the image inspection unit 24 inspects the toner image (image), fixed to the sheet P, for the presence/absence and the seriousness of a toner concentration defect, an image defect, an image position defect, or the like. Finally, the sheet P is output to the output unit 59.

When forming an image on a surface of sheet P on which the image has not been formed, that is, in duplex printing, the controller 70 changes the transport path of the sheet P, after passing through the image inspection unit 24, to the reverse path 26. Thus, the sheet P is reversed and is transported to the second-transfer position NT. To the back surface of the sheet P, an image is transferred and fixed in the same way as to the front surface. Postprocessing is performed on the image on the back surface in the same way as on the image on the front surface, and the sheet P is output to the output unit 59.

Structures of Elements

Next, the structures of elements of the present exemplary embodiment will be described.

Toner

Figure 5A:
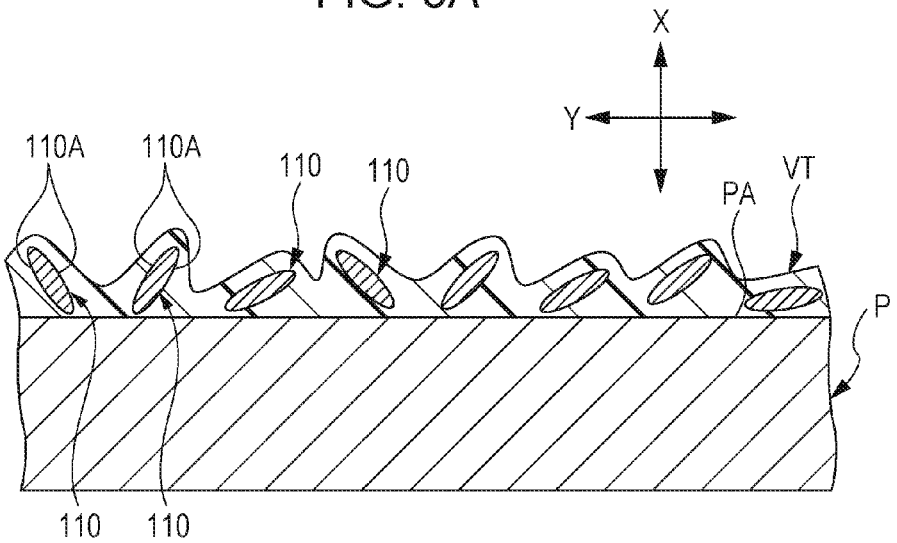
FIG. 5A is a schematic sectional view illustrating a state in which particles of a metallic pigment do not extend parallel to a surface of a sheet.
Figure 5B:
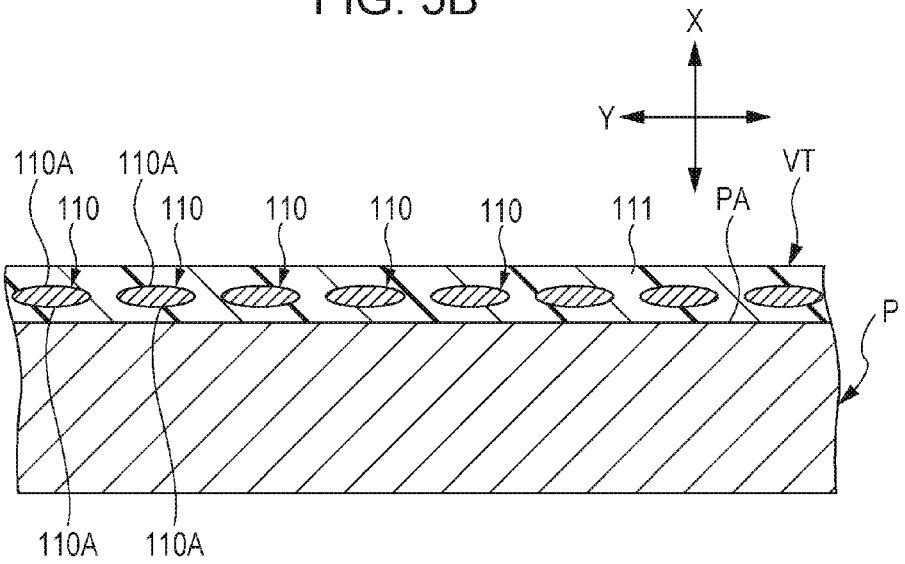
FIG. 5B is a schematic sectional view illustrating a state in which the particles of the metallic pigment extend substantially parallel the surface of the sheet.

As illustrated in FIGS. 5A and 5B, a silver toner, which is used as a first specific color (V) toner, includes the flat metallic pigment 110 (see also FIGS. 6A and 6B) and a binder resin 111. The silver toner is used to form an image having a metallic gloss. Note that an image having a metallic gloss may be formed by using a silver toner and a non-silver toner or may be formed by using only a silver toner.

The metallic pigment 110 according to the present exemplary embodiment is mainly made of aluminum. As illustrated in FIG. 6B, in a side view, a particle of the metallic pigment 110 has a dimension in the left-right direction that is larger than that in the up-down direction.

Figure 6A:
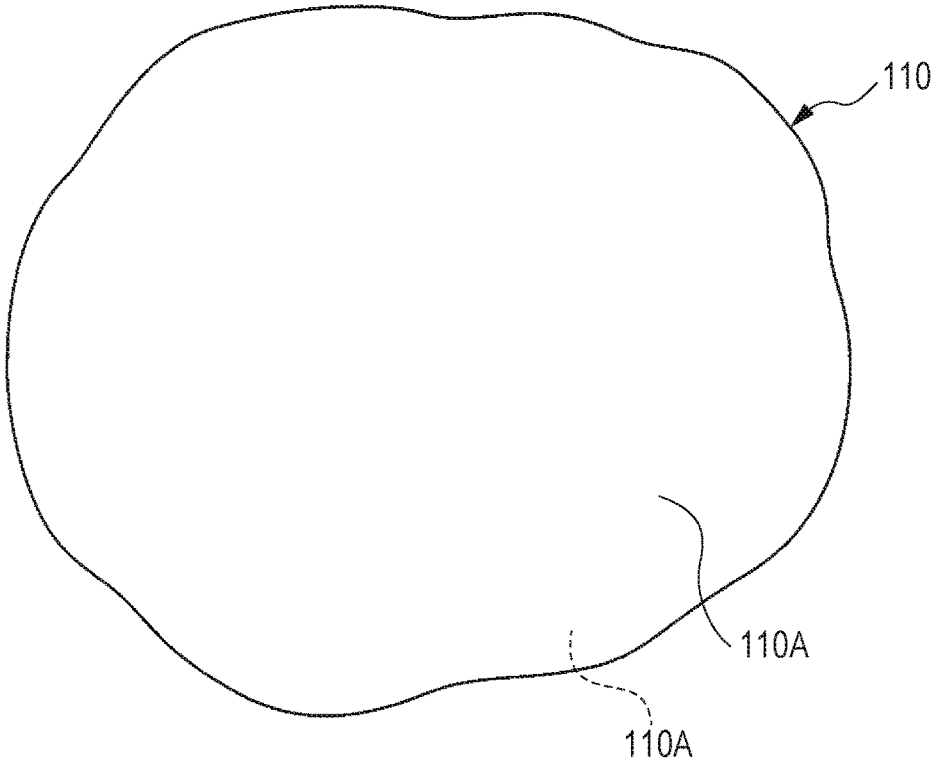
FIG. 6A is a plan view and FIG. 6B is a side view of a particle of the metallic pigment.
Figure 6B:
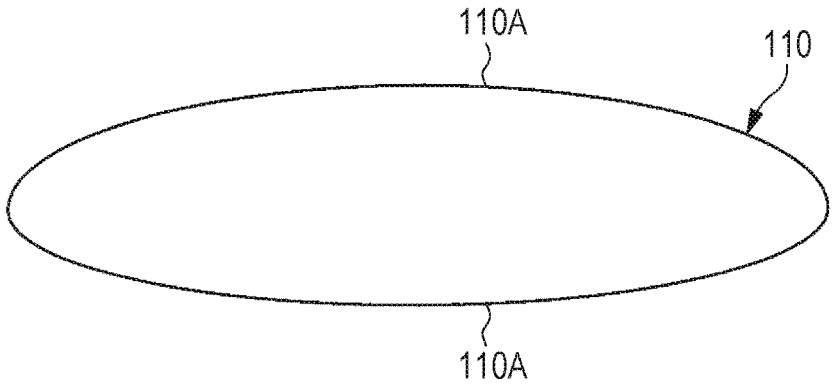

As illustrated in FIG. 6A, in a plan view, a particle of the metallic pigment 110 has an area that is larger than the area of the particle in the side view shown in FIG. 6B. Each particle of the metallic pigment 110 has a pair of reflective surfaces 110A (flat surfaces) that face upward or downward when the particle of the metallic pigment 110 is placed on a horizontal surface (see FIG. 6B). Thus, the metallic pigment 110 has a flat shape.

A second specific color (W) toner, a yellow (Y) toner, a magenta (M) toner, a cyan (C) toner, and a black (K) toner are non-silver toners (which may be called "ordinary toners"). Each of the non-silver toners includes a pigment (such as an organic pigment or an inorganic pigment) that does not include a flat metallic pigment, and a binder resin.

Controller

When receiving an instruction to form an image at least a part of which has a metallic gloss, the controller 70 activates the toner image forming unit 30V for silver and the toner image forming units 30 for other colors or activates only the toner image forming unit 30V for silver.

When receiving an instruction to form an image that does not have a metallic gloss, the controller 70 activates only the toner image forming units 30 other than the toner image forming unit 30V.

Figure 17B:
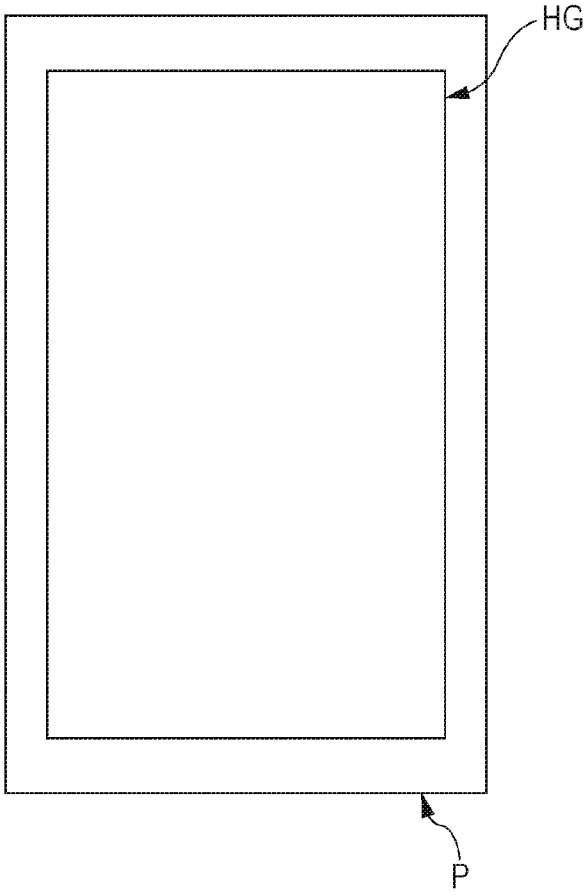
FIG. 17B is a plan view illustrating a second surface of the sheet on which an ordinary image is formed.
Figure 17A:
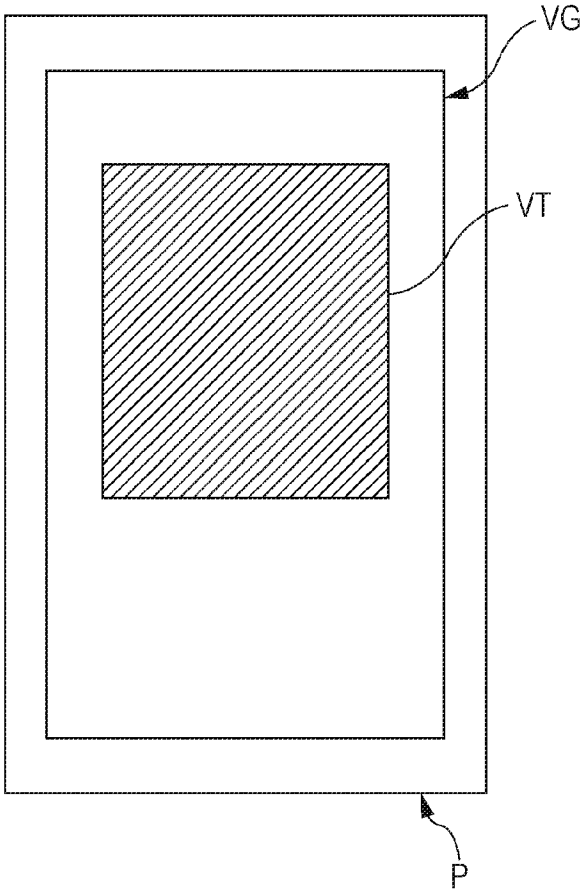
FIG. 17A is a plan view illustrating a first surface of a sheet on which a glossy image is formed.

Referring to FIG. 17A, a glossy image VG (which is an example of a first image) is an image that includes a silver toner image VT (which is an example of a metallic color image) having a metallic gloss and formed by using the first specific color (V) toner, that is, the silver toner. Referring to FIG. 17B, an ordinary image HG (which is an example of a second image) is an image that does not include the silver toner image VT (FIG. 17A) and includes only an ordinary toner image.

Mode

In the present exemplary embodiment, the image forming apparatus 10 has a gloss mode in which the image forming apparatus 10 improves the metallic gloss of a glossy image VG (FIG. 17A) in duplex printing. The gloss mode will be described below in the section "Operations and Effects" below.

As described above, the image forming apparatus 10 has a reverse mode in which, in simplex printing, a sheet P is output so that a surface of the sheet P on which an image is formed faces downward, and, in duplex printing, a sheet P is output so that a surface of the sheet P on which an image is subsequently formed faces downward.

A user selects the gloss mode and the reverse mode by operating the operation unit 80.

In job data, a surface of a sheet P to which a toner image is to be first transferred and fixed in duplex printing will be referred to as a "front surface" and a surface on which a toner image is to be subsequently transferred and fixed will be referred to as a "back surface". A user selects the reverse mode when the user wants the sheet P to be output so that the front surface, on which an image is first formed, faces upward and the back surface, on which an image is subsequently formed, faces downward.

Operations and Effects

Next, operations and effects will be described.

FIGS. 17A and 17B illustrate a sheet P on a first surface of which a glossy image VG is formed (FIG. 17A) and on a second surface of which an ordinary image HG is formed (FIG. 17B) in duplex printing.

FIGS. 18A to 19B each illustrate a sheet P on both surfaces of which glossy images VG are formed in duplex printing.

Figure 18B:
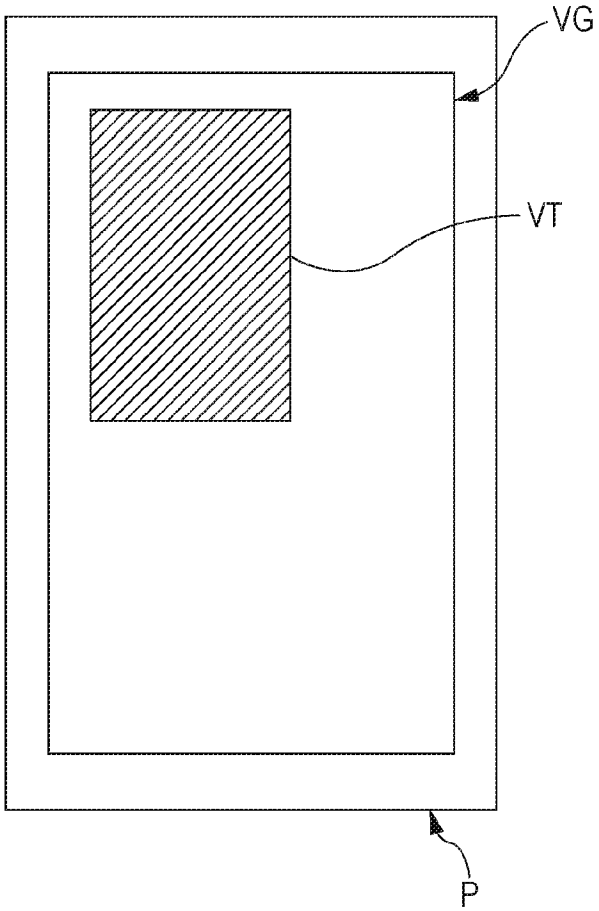
FIG. 18B is a plan view illustrating a second surface of the sheet on which a glossy image including a silver toner image having a smaller area is formed, the glossy images being formed by the image forming apparatus according to the exemplary embodiment.
Figure 18A:
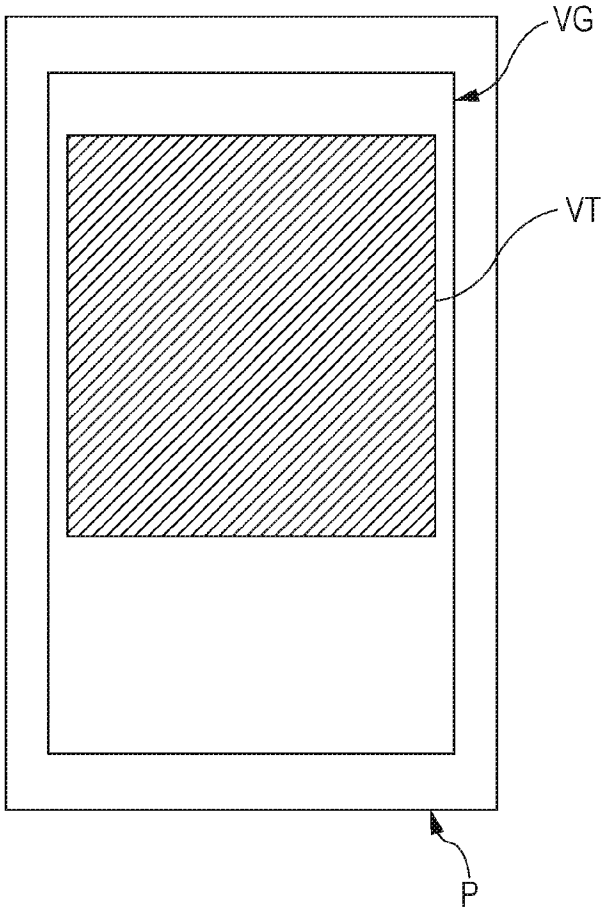
FIG. 18A is a plan view illustrating a first surface of a sheet on which a glossy image including a silver toner image having a larger area is formed.

To be specific, FIG. 18A illustrates a first surface of a sheet P on which a glossy image VG including a silver toner image VT having a larger area is formed, and FIG. 18B illustrates a second surface of the sheet P on which a glossy image VG including a silver toner image VT having a smaller area is formed.

Figure 19B:
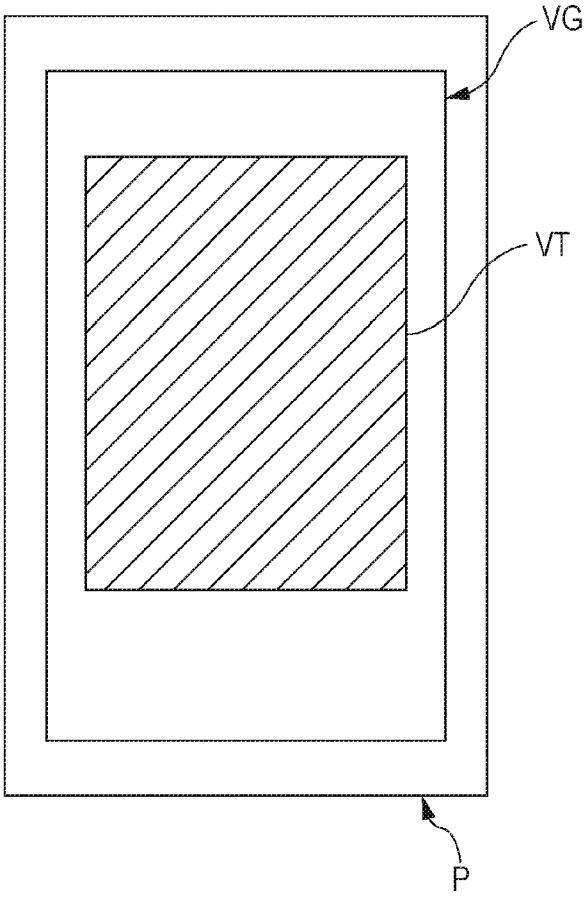
FIG. 19B is a plan view illustrating a second surface of the sheet on which a glossy image including a silver toner image having a lower dot percent is formed, the glossy images being formed by the image forming apparatus according to the exemplary embodiment and the silver toner images having the same area.
Figure 19A:
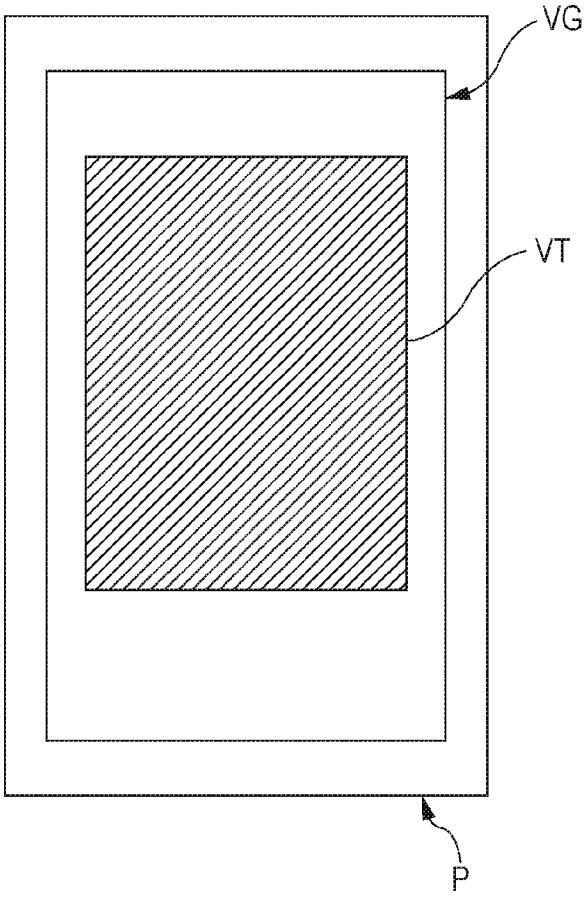
FIG. 19A is a plan view illustrating a first surface of a sheet on which a glossy image including a silver toner image having a higher dot percent is formed.

FIG. 19A illustrates a first surface of a sheet P on which a glossy image VG including a silver toner image VT having a higher dot percent is formed, and FIG. 19B illustrates a second surface of the sheet P on which a glossy image VG including a silver toner image VT having a lower dot percent is formed, the silver toner images VT having the same area.

When the reflective surfaces 110A of the metallic pigment 110 of a silver toner image VT extend substantially parallel to the sheet surface PA as illustrated in FIG. 5B, as compared with a case where the reflective surfaces 110A extend in different directions as illustrated in FIG. 5A, diffusion of light reflected from the silver toner image VT is reduced. Thus, the flop index is improved.

The flop index (FI), which is measured in accordance with ASTM E2194, represents a metallic gloss that is visible by reflected light. The larger the flop index, the higher the metallic gloss.

By making a sheet P, on which a glossy image VG including a silver toner image VT has been transferred, pass through the fixing unit 34 (FIGS. 1 and 2), the binder resin 111 of the silver toner becomes softened so that the reflective surfaces 110A of the flat metallic pigment 110 included in the silver toner image VT extend substantially parallel to the sheet surface PA.

Moreover, by making the sheet P, to which the glossy image VG including the silver toner image VT has been fixed, pass through the fixing unit 34 (FIGS. 1 and 2) again, the binder resin 111 becomes softened again and the reflective surfaces 110A of the flat metallic pigment 110 become closer to parallel to the sheet surface PA, and the flop index is improved.

However, if the sheet P is made to pass through the fixing unit 34 twice, the productivity is reduced while the flop index is improved.

In duplex printing, an image is fixed to a first surface of a sheet P, the sheet P is reversed in the reverse path 26, an image is transferred to a second surface of the sheet P, and the image is fixed to the second surface. Thus, the image on the first surface, which is first transferred and fixed to the sheet P, passes through the fixing unit 34 twice.

In the present exemplary embodiment, in duplex printing, when the gloss mode is selected and when forming a glossy image VG including a silver toner image VT (FIG. 17A) on a first surface of a sheet P and an ordinary image HG (FIG. 17B) on a second surface of the sheet P, the glossy image VG is first transferred and fixed to the sheet P regardless of whether the glossy image VG is on the front surface or the back surface. Therefore, the glossy image VG passes through the fixing unit 34 twice without reducing the productivity. Thus, the reflective surfaces 110A of the flat metallic pigment 110 of the silver toner image VT become closer to parallel to the sheet surface PA illustrated in FIG. 5B, and the flop index is improved.

Moreover, when forming glossy images VG on both surfaces of a sheet P, the amount of the metallic pigment 110 in which the reflective surfaces 110A extend substantially parallel to the sheet surface PA is increased. In other words, when forming glossy images VG on both surfaces, the amount of the metallic pigment 110 that passes through the fixing unit 34 twice is increased.

To be specific, in the present exemplary embodiment, by first transferring and fixing a glossy image VG including a silver toner image VT having a larger area (FIG. 18A) to a sheet P, the glossy image VG including the silver toner image VT having a larger area necessarily passes through the fixing unit 34 twice. Thus, in the flat metallic pigment 110 of the silver toner image VT having a larger area, the reflective surfaces 110A shown in FIG. 5B become closer to parallel to the sheet surface PA, and the flop index is improved.

If at least one of the glossy images VG includes plural silver toner images VT, one of the glossy images VG including silver toner images VT the sum of the areas of which is larger (the total area of the silver toner images VT is larger) is first transferred and fixed to the sheet P.

If the glossy images VG include silver toner images VT having the same area, one of the glossy images VG (FIG. 19A) including a silver toner image VT having a higher dot percent (Cin) is first transferred and fixed to the sheet P, so that the one of the glossy images VG (FIG. 19A) necessarily passes through the fixing unit 34 twice. Thus, in the silver toner image VT having a higher dot percent (Cin), the reflective surfaces 110A shown in FIG. 5B become closer to parallel to the sheet surface PA, and the flop index is improved.

If at least one of the glossy images VG includes plural silver toner images VT, one of the glossy images VG including a silver toner image VT having the highest dot percent is first transferred and fixed to the sheet P.

As described above, in the present exemplary embodiment, the glossy image VG including a silver toner image VT having a larger area (FIG. 18A), or, if the silver toner images VT have the same area, the glossy image VG including a silver toner image VT having a higher dot percent (FIG. 19A) necessarily passes through the fixing unit 34 twice. Therefore, the reflective surfaces 110A of the flat metallic pigment 110 of the silver toner image VT become closer to parallel to the sheet surface PA, and the flop index is improved.

If the silver toner images VT formed on both surfaces have the same area and the same dot percent (Cin), either of the silver toner images VT may pass through the fixing unit 34 twice.

In the present exemplary embodiment, even when the gloss mode is selected, the sheet P is output so that one of the surfaces of the sheet P faces upward as intended by a user. This will be described below in the section "Control of Gloss Mode" below.

Control of Gloss Mode

Next, an example of control of the gloss mode will be described.

To be specific, referring to FIGS. 7 to 12 (flowcharts), how the controller 70 controls duplex printing when forming a glossy image VG including a silver toner image VT on a first surface of a sheet P or when forming glossy images VG including silver toner images VT on both surfaces of a sheet P and when the gloss mode is selected.

Descriptions of how the controller 70 controls simplex printing, how the controller 70 controls duplex printing when forming ordinary images HG on both surfaces, and how the controller 70 controls duplex printing when the gloss mode is not selected will be omitted, because, in these cases, the controller 70 may perform control in the same way as in exiting technologies.

As described above, FIGS. 17A and 17B illustrate a sheet P on a first surface of which a glossy image VG (FIG. 17A) is formed and on a second surface of which an ordinary image HG (FIG. 17B) is formed in duplex printing. FIGS. 18A to 19B each illustrate a sheet P on both surfaces of which glossy images VG are formed in duplex printing.

The types of images to be formed on the front surface and the back surface of the recording medium P are determined on the basis of job data.

Forming Glossy Image on First Surface and Ordinary Image on Second Surface

Figure 7:
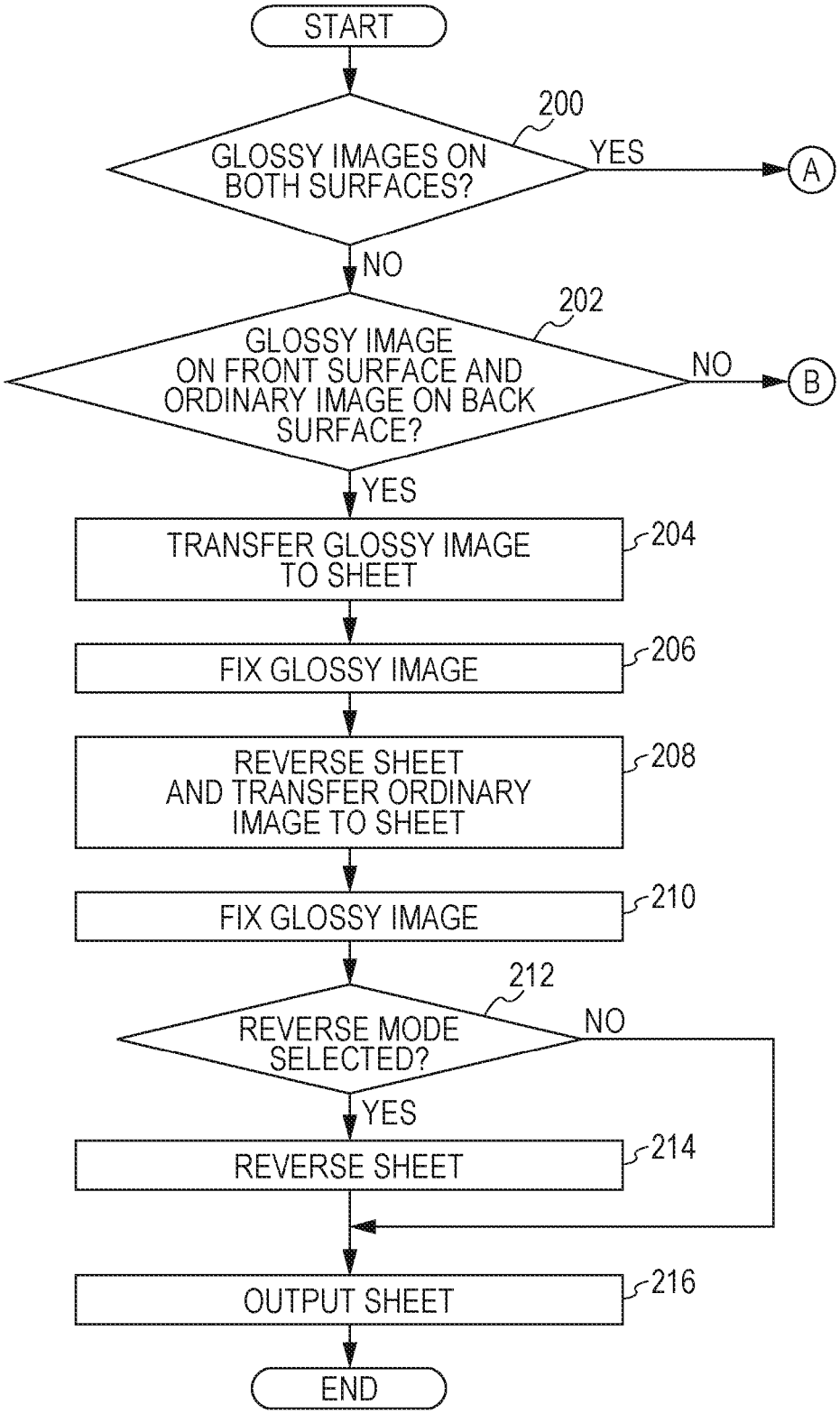
FIG. 7 is a flowchart of a process through which the image forming apparatus according to the exemplary embodiment forms a glossy image and an ordinary image respectively on a first surface and a second surface of a sheet when a gloss mode is selected.
Figure 9:
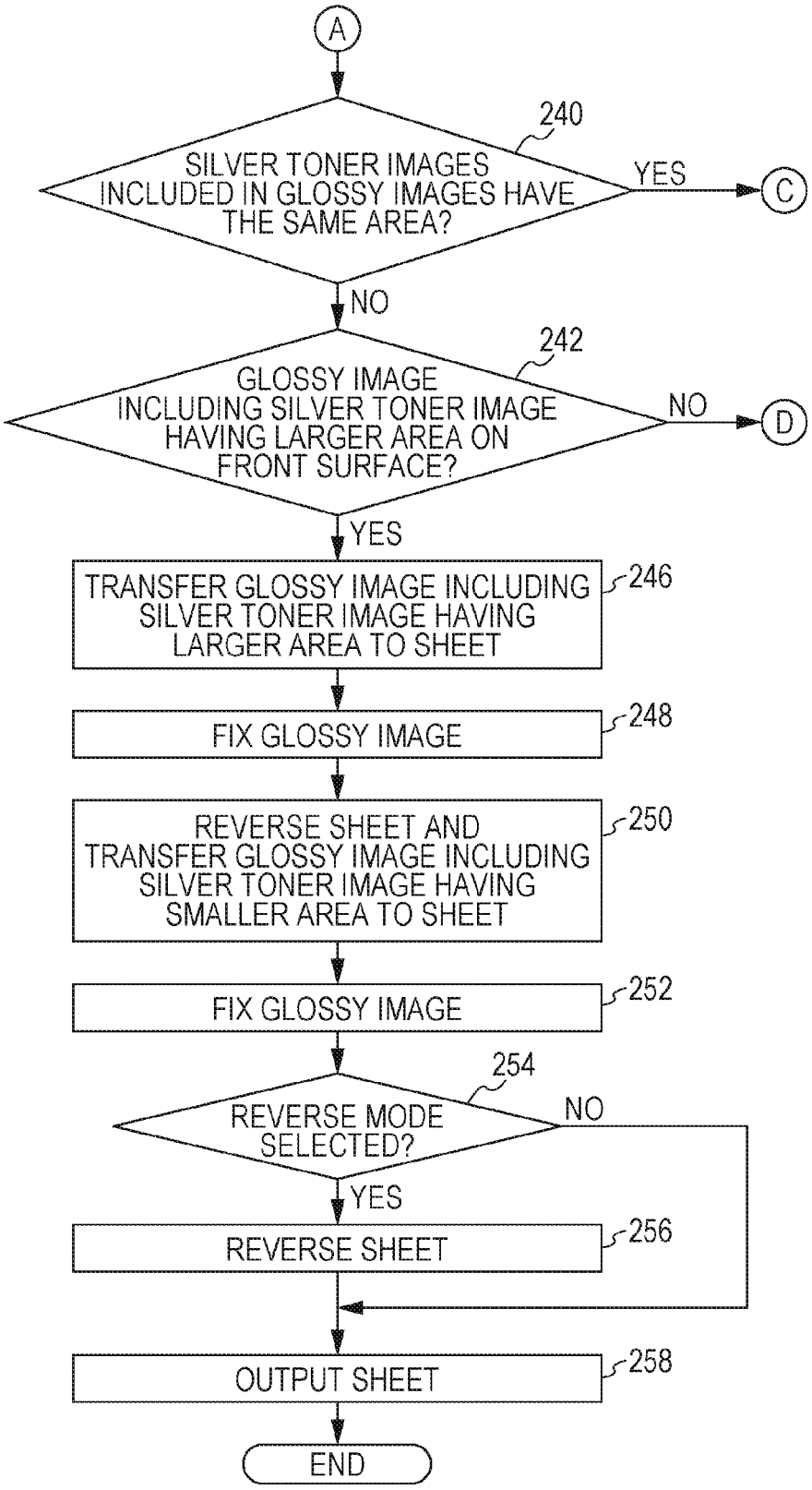
FIG. 9 is a flowchart of a process through which the image forming apparatus according to the exemplary embodiment forms glossy images on both surfaces of a sheet when a gloss mode is selected.

Referring to FIG. 7, in step 200, on the basis of job data, the controller 70 determines whether or not glossy images VG (FIG. 17A and other figures) are to be formed on both surfaces. If glossy images VG are to be formed on both surfaces, the process proceeds to step 240 (FIG. 9). If a glossy image VG is to be formed on a first surface and an ordinary image HG (FIG. 17B) is to be formed on a second surface, the process proceeds to step 202.

Forming Glossy Image on Front Surface and Ordinary Image on Back Surface

In step 202, on the basis of job data, the controller 70 determines whether or not to form a glossy image VG (FIG. 17A) on the front surface of the sheet P and an ordinary image HG (FIG. 17B) on the back surface of the sheet P.

Figure 8:
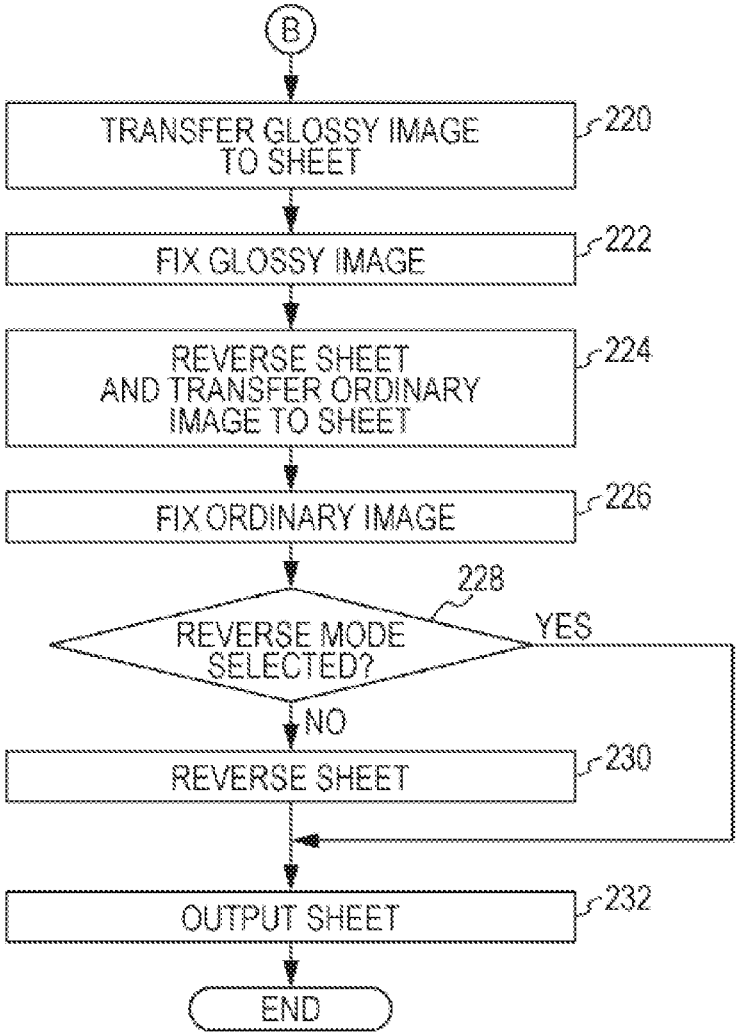
FIG. 8 is a flowchart of a process through which the image forming apparatus according to the exemplary embodiment forms a glossy image and an ordinary image respectively on a first surface and a second surface of a sheet when a gloss mode is selected.

If a glossy image VG is to be formed on the front surface of the sheet P and an ordinary image HG is to be formed on the back surface of the sheet P, the process proceeds to step 204. If not, the process proceeds to step 220 (FIG. 8).

In step 204, the glossy image VG is transferred to the sheet P, and the process proceeds to step 206. In step 206, the glossy image VG is fixed to the sheet P by the fixing unit 34 (FIGS. 1 and 2), and the process proceeds to step 208.

In step 208, the sheet P is reversed in the reverse path 26, the ordinary image HG is transferred to the sheet P, and the process proceeds to step 210. In step 210, the ordinary image HG is fixed to the sheet P by the fixing unit 34, and the process proceeds to step 212.

In step 212, on the basis of job data, the controller 70 determines whether or not the reverse mode is selected.

If the reverse mode is selected, the process proceeds to step 214. As illustrated in FIGS. 4A to 4C, the sheet P is reversed by being transported into the branch path 26P1 of the reverse path 26 to change the transport direction and transported through the branch reverse path 26P4. Then, the process proceeds to step 216, and the sheet P is output so that a surface on which the glossy image VG is formed faces upward.

If the reverse mode is not selected, the process proceeds to step 216, and the sheet P is output so that a surface on which the ordinary image HG is formed faces upward.

Forming Ordinary Image on Front Surface and Glossy Image on Back Surface

As described above, if it is determined in step 202 that a glossy image VG is not to be formed on the front surface of the sheet P (but is to be formed on the back surface), the process proceeds to step 220 shown in FIG. 8.

In step 220, the order of forming the ordinary image HG and the glossy image VG is switched over, the glossy image VG is first transferred to the sheet P, and the process proceeds to step 222. In step 222, the glossy image VG is fixed to the sheet P by the fixing unit 34 (FIGS. 1 and 2), and the process proceeds to step 224.

In step 224, the sheet P is reversed in the reverse path 26, the ordinary image HG is transferred to the sheet P, and the process proceeds to step 226. In step 226, the ordinary image HG is fixed to the sheet P by the fixing unit 34, and the process proceeds to step 228.

In step 228, on the basis of job data, the controller 70 determines whether or not the reverse mode is selected.

A user recognizes that the ordinary image HG (FIG. 17B) is formed on the front surface, and, if the user has selected the reverse mode, the user wants the sheet P to be output so that the front surface, on which the ordinary image HG is formed, faces upward. If the user has not selected the reverse mode, the user recognizes that the glossy image VG (FIG. 17A) is formed on the back surface, and the user wants the sheet P to be output so that the back surface, on which the glossy image VG is formed, faces upward.

Thus, if the reverse mode is selected, the process proceeds to step 232, the sheet P is not reversed, and the sheet P is output so that the surface on which the ordinary image HG is formed faces upward.

If the reverse mode is not selected, the process proceeds to step 230. As illustrated in FIGS. 4A to 4C, the sheet P is reversed, the process proceeds to step 232, and the sheet P is output so that the surface on which the glossy image VG is formed faces upward.

Forming Glossy Images on Both Surfaces

As described above, if it is determined in step 200 that glossy images VG are to be formed on both surfaces, the process proceeds to step 240 shown in FIG. 9.

Figure 11:
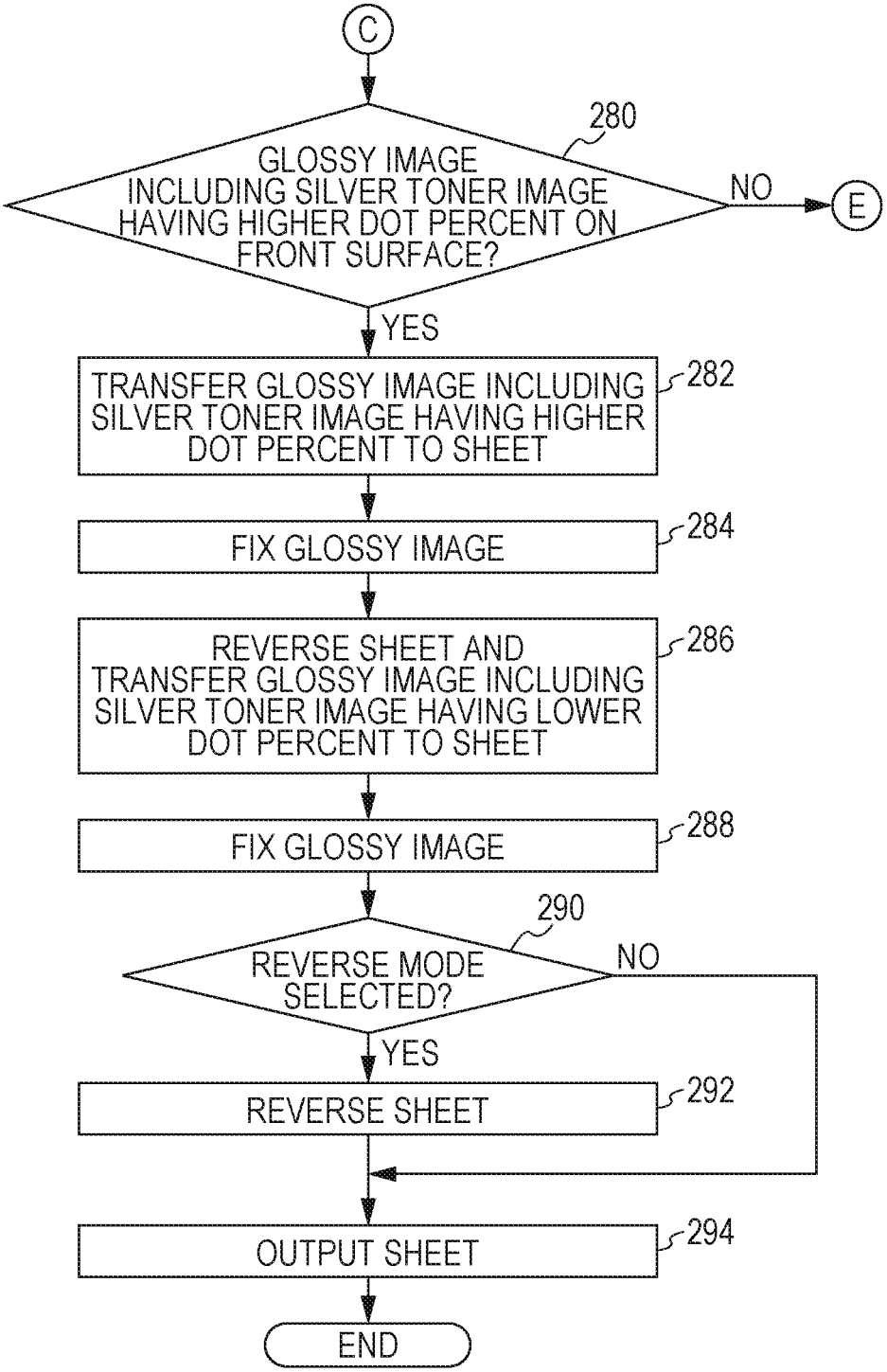
FIG. 11 is a flowchart of a process through which the image forming apparatus according to the exemplary embodiment forms glossy images on both surfaces of a sheet when a gloss mode is selected.

Forming Glossy Images VG Including Silver Toner Images VT Having Different Areas Referring to FIG. 9, in step 240, on the basis of job data, the controller 70 determines whether or not the silver toner images VT included in the glossy images VG have the same area. If the silver toner images VT have the same area, the process proceeds to step 280 (FIG. 11). If not, the process proceeds to step 242.

Forming Silver Toner Image Having Larger Area on Front Surface

Figure 10:
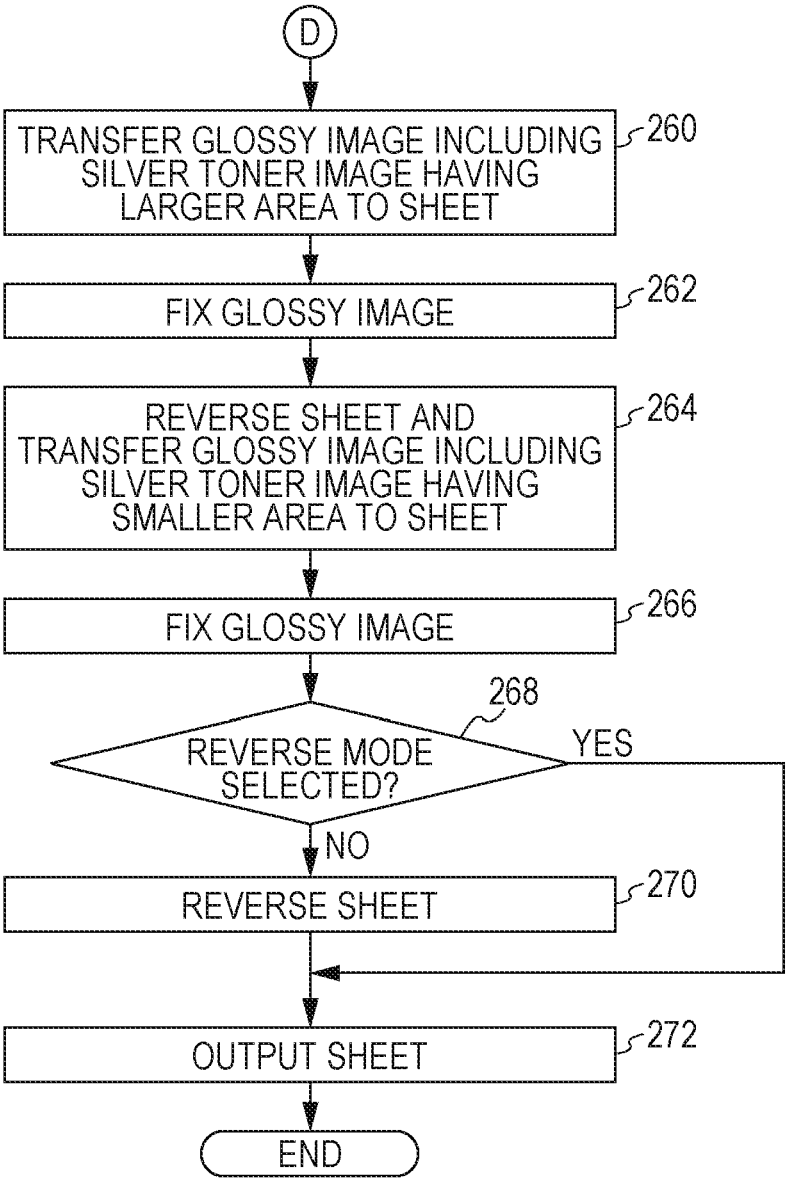
FIG. 10 is a flowchart of a process through which the image forming apparatus according to the exemplary embodiment forms glossy images on both surfaces of a sheet when a gloss mode is selected.

In step 242, the controller 70 determines whether or not a glossy image VG including a silver toner image VT having a larger area is to be formed on the front surface on the basis of job data. If a glossy image VG including a silver toner image VT having a larger area (as shown in FIG. 18A) is to be formed on the front surface, the process proceeds to step 246. If the glossy image VG is to be formed on the back surface, the process proceeds to step 260 (FIG. 10).

In step 246, the glossy image VG including a silver toner image VT having a larger area (FIG. 18A) is transferred to the sheet P, and the process proceeds to step 248. In step 248, the glossy image VG (FIG. 18A) is fixed to the sheet P by the fixing unit 34 (FIGS. 1 and 2), and the process proceeds to step 250.

In step 250, the sheet P is reversed in the reverse path 26, a glossy image VG including a silver toner image VT having a smaller area (FIG. 18B) is transferred to the sheet P, and the process proceeds to step 252. In step 252, the glossy image VG (FIG. 18B) is fixed to the sheet P by the fixing unit 34, and the process proceeds to step 254.

In step 254, on the basis of job data, the controller 70 determines whether or not the reverse mode is selected.

If the reverse mode is selected, the process proceeds to step 256. As illustrated in FIGS. 4A to 4C, the sheet P is reversed, the process proceeds to step 258, and the sheet P is output so that the front surface, on which the glossy image VG including a silver toner image VT having a larger area (FIG. 18A) is formed, faces upward.

If the reverse mode is not selected, the process proceeds to step 258, and the sheet P is output so that a surface on which the glossy image VG including a silver toner image VT having a smaller area (FIG. 18B) is formed faces upward.

Forming Glossy Image Including Silver Toner Image Having Larger Area on Back Surface As described above, if it is determined in step 242 that a glossy image VG including a silver toner image VT having a larger area (as shown in FIG. 18A) is not to be formed on the front surface (but is to be formed on the back surface), the process proceeds to step 260 shown in FIG. 10.

In step 260, the order of forming the glossy image VG including a silver toner image VT having a smaller area (as shown in FIG. 18B) and the glossy image VG including a silver toner image VT having a larger area (as shown in FIG. 18A) is switched. The glossy image VG including a silver toner image VT having a larger area (FIG. 18A) is first transferred to the sheet P, and the process proceeds to step 262. In step 262, the glossy image VG (FIG. 18A) is fixed to the sheet P by the fixing unit 34 (FIGS. 1 and 2), and the process proceeds to step 264.

In step 264, the sheet P is reversed in the reverse path 26, the glossy image VG including a silver toner image VT having a smaller area (FIG. 18B) is transferred to the sheet P, and the process proceeds to step 266. In step 266, the glossy image VG (FIG. 18B) is fixed to the sheet P by the fixing unit 34, and the process proceeds to step 268.

In step 268, on the basis of job data, the controller 70 determines whether or not the reverse mode is selected.

A user recognizes that the glossy image VG including a silver toner image VT having a smaller area (FIG. 18B) is formed on the front surface, and, if the user has selected the reverse mode, the user wants the sheet P to be output so that the front surface, on which the glossy image VG including a silver toner image VT having a smaller area is formed, faces upward. If the user has not selected the reverse mode, the user wants that the sheet P is output so that the back surface, on which the glossy image VG including a silver toner image VT having a larger area (FIG. 18A) is formed, faces upward.

Thus, if the reverse mode is selected, the process proceeds to step 272, the sheet P is not reversed, and the sheet P is output so that a surface on which the glossy image VG including a silver toner image VT having a smaller area (FIG. 18B) is formed faces upward.

If the reverse mode is not selected, the process proceeds to step 270. As illustrated in FIGS. 4A to 4C, the sheet P is reversed, the process proceeds to step 272, and the sheet P is output so that a surface on which the glossy image VG including a silver toner image VT having a larger area (FIG. 18A) is formed faces upward.

Forming Glossy Images Including Silver Toner Images Having the Same Area

As described above, if it is determined in step 240 shown in FIG. 9 that silver toner images VT included in glossy images VG have the same area, the process proceeds to step 280 shown in FIG. 11.

Figure 12:
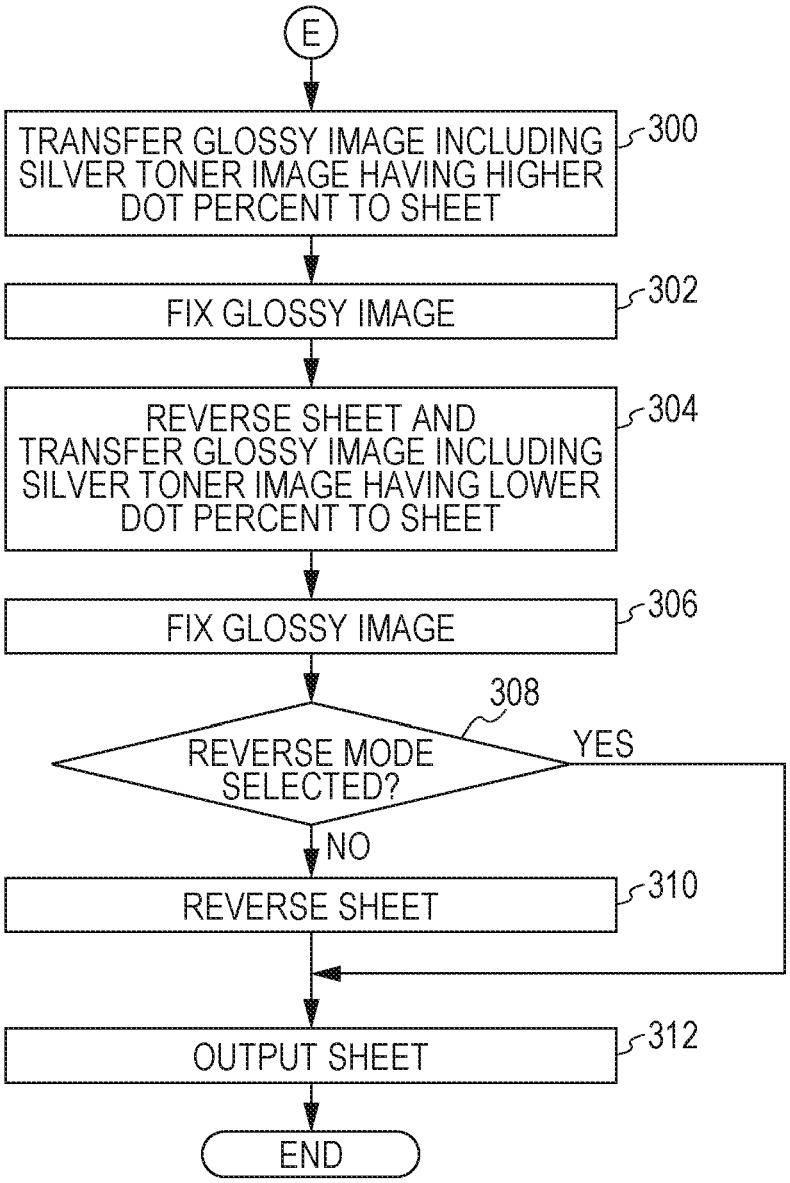
FIG. 12 is a flowchart of a process through which the image forming apparatus according to the exemplary embodiment forms glossy images on both surfaces of a sheet when a gloss mode is selected.

Referring to FIG. 11, in step 280, on the basis of job data, the controller 70 determines whether or not a glossy image VG including a silver toner image VT having a higher dot percent (FIG. 19A) is to be formed on the front surface. If the glossy image VG including a silver toner image VT having a higher dot percent is to be formed on the front surface, the process proceeds to step 282. It the glossy image VG is to be formed on the back surface, the process proceeds to step 300 (FIG. 12).

Forming Glossy Image Including Silver Toner Image Having Higher Dot Percent on Front Surface In step 282, the glossy image VG including a silver toner image VT having a higher dot percent (FIG. 19A) is transferred to the sheet P, and the process proceeds to step 284. In step 284, the glossy image VG (FIG. 19A) is fixed to the sheet P by the fixing unit 34 (FIGS. 1 and 2), and the process proceeds to step 286.

In step 286, the sheet P is reversed in the reverse path 26, a glossy image VG (FIG. 19B) including a silver toner image VT having a lower dot percent is transferred to the sheet P, and the process proceeds to step 288. In step 288, the glossy image VG (FIG. 19B) is fixed to the sheet P by the fixing unit 34, and the process proceeds to step 290.

In step 290, on the basis of job data, the controller 70 determines whether or not the reverse mode is selected.

If the reverse mode is selected, the process proceeds to step 292. As illustrated in FIGS. 4A to 4C, the sheet P is reversed, the process proceeds to step 294, and the sheet P is output so that a surface on which the glossy image VG including a silver toner image VT having a higher dot percent (FIG. 19A) is formed faces upward.

If the reverse mode is not selected, the process proceeds to step 258, and the sheet P is output so that a surface on which the glossy image VG (FIG. 19B) including a silver toner image VT having a lower dot percent is formed faces upward.

Forming Glossy Image Including Silver Toner Image Having Higher Dot Percent on Back Surface As described above, if it is determined in step 280 that the glossy image VG including a silver toner image VT having a higher dot percent is not to be formed on the front surface (but is to be formed on the back surface), the process proceeds to step 300 (FIG. 12).

In step 300, the order of forming a glossy image VG including a silver toner image VT having a lower dot percent (as shown in FIG. 19B) and the glossy image VG including a silver toner image VT having a higher dot percent (as shown in FIG. 19A) is switched. The glossy image VG including a silver toner image VT having a higher dot percent (FIG. 19A) is first transferred to the sheet P, and the process proceeds to step 302. In step 302, the glossy image VG (FIG. 19A) is fixed to the sheet P by the fixing unit 34 (FIGS. 1 and 2), and the process proceeds to step 304.

In step 304, the sheet P is reversed in the reverse path 26, the glossy image VG including a silver toner image VT having a lower dot percent (FIG. 19B) is transferred to the sheet P, and the process proceeds to step 302. In step 302, the glossy image VG (FIG. 19B) is fixed to the sheet P by the fixing unit 34, and the process proceeds to step 308.

In step 308, on the basis of job data, the controller 70 determines whether or not the reverse mode is selected.

If a user has selected the reverse mode, the user recognizes that the glossy image VG (FIG. 19B) including a silver toner image VT having a lower dot percent is formed on the front surface, and the user wants the sheet P to be output so that the front surface, on which the glossy image VG (FIG. 19B) is formed, faces upward. If the user has not selected the reverse mode, the user wants the sheet P to be output so that a surface on which the glossy image VG including a silver toner image VT having a higher dot percent (FIG. 19A) is formed faces upward.

Thus, if the reverse mode is selected, the process proceeds to step 312, the sheet P is not reversed, and the sheet P is output so that a surface on which the glossy image VG including a silver toner image VT having a lower dot percent (FIG. 19B) is formed faces upward.

If the reverse mode is not selected, the process proceeds to step 310. As illustrated in FIGS. 4A to 4C, the sheet P is transported into the branch path 26P1 of the reverse path 26 to change the transport direction and transported through the branch reverse path 26P4, and the sheet P is output so that a surface on which the glossy image VG including a silver toner image VT having a higher dot percent (FIG. 19A) is formed faces upward.

If the silver toner images VT to be formed on both surfaces have the same area and have the same dot percent (Cin), the controller 70 may perform control in the same way as in existing technologies.

Modification

Next, a modification of the exemplary embodiment of the present invention will be described.

The modification differs from the exemplary embodiment in how the controller 70 performs control when forming glossy images on both surfaces. Only this difference will be described.

FIGS. 20A to 21B each illustrate a sheet P on which glossy images VG are formed on both surfaces according to the modification.

Figure 20B:
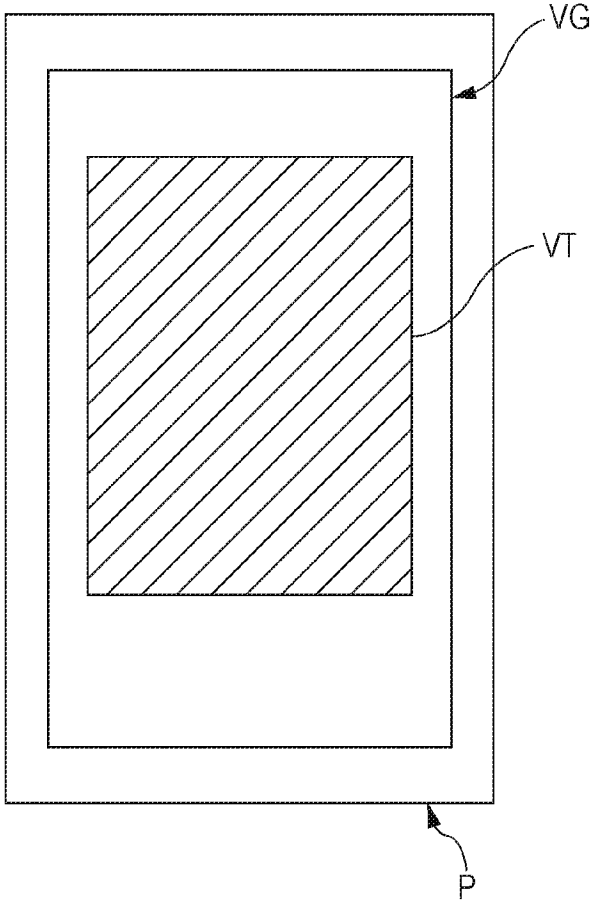
FIG. 20B is a plan view illustrating a second surface of the sheet on which a glossy image including a silver toner image having a lower dot percent is formed, the glossy images being formed by the image forming apparatus according to the modification.
Figure 20A:
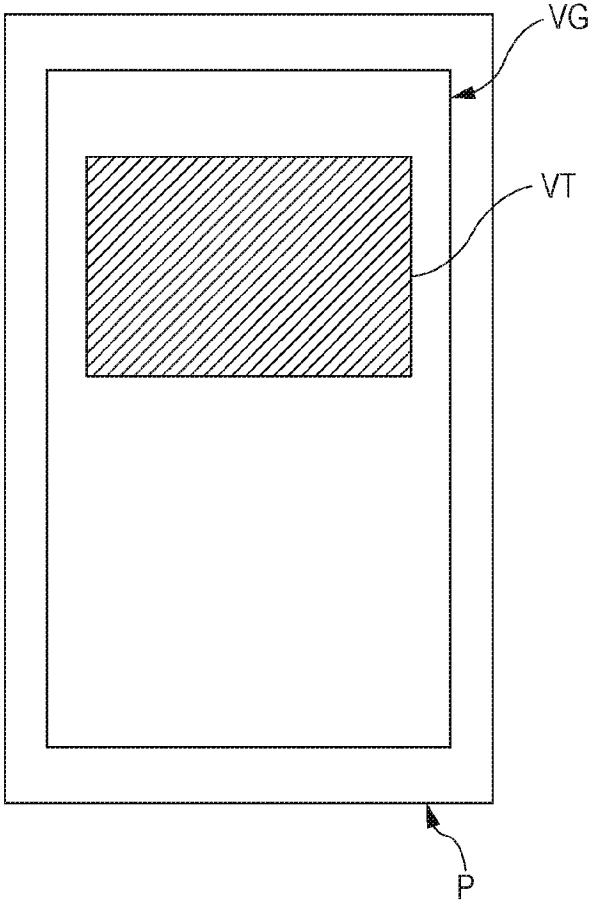
FIG. 20A is a plan view illustrating a first surface of a sheet on which a glossy image including a silver toner image having a higher dot percent is formed.

To be specific, FIG. 20A illustrates a first surface of a sheet P on which a glossy image VG including a silver toner image VT having a higher dot percent is formed, and FIG. 20B illustrates a second surface of the sheet P on which a glossy image VG including a silver toner image VT having a lower dot percent is formed.

Figure 21B:
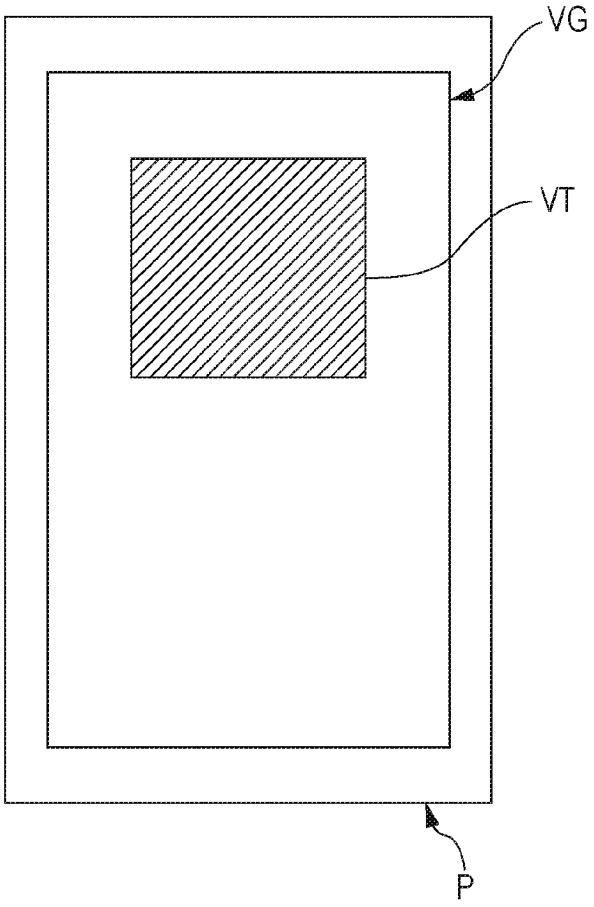
FIG. 21B is a plan view illustrating a second surface of the sheet on which a glossy image including a silver toner image having a smaller area is formed, the glossy images being formed by the image forming apparatus according to the modification and the silver toner images having the same dot percent.
Figure 21A:
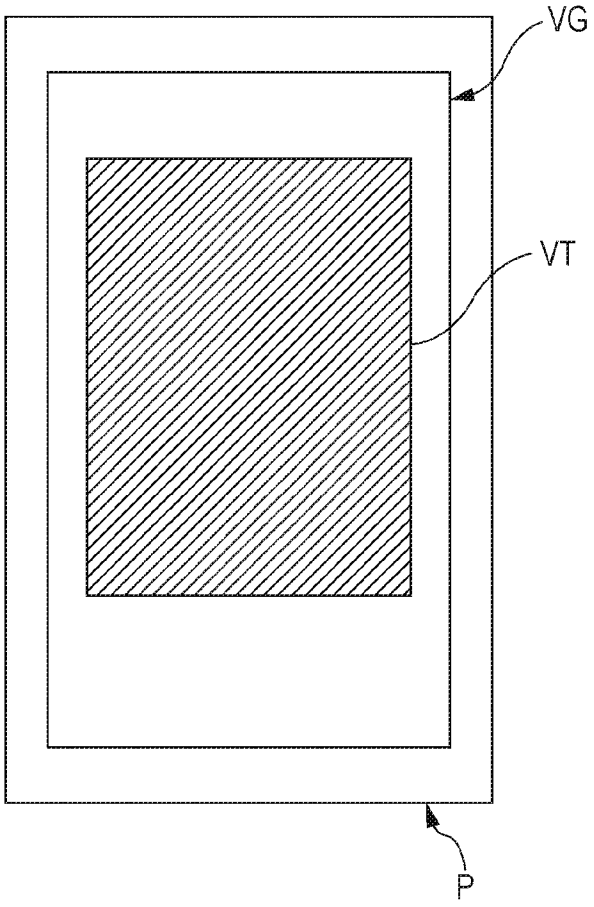
FIG. 21A is a plan view illustrating a first surface of a sheet on which a glossy image including a silver toner image having a larger area is formed.

FIG. 21A illustrates a first surface of a sheet P on which a glossy image VG including a silver toner image VT having a larger area is formed, and FIG. 21B illustrates a second surface of the sheet P on which a glossy image VG including a silver toner image VT having a smaller area is formed, the silver toner images VT having the same dot percent.

In the present modification, when forming glossy images VG on both surfaces, a glossy image VG including a silver toner image VT having a higher dot percent (FIG. 20A) is first transferred and fixed to the sheet P, so that the glossy image VG including a silver toner image VT having a higher dot percent necessarily passes through the fixing unit 34 twice. Thus, the reflective surfaces 110A of the flat metallic pigment 110 of the silver toner image VT having a higher dot percent become closer to parallel to the sheet surface PA illustrated in FIG. 5B, and the flop index is improved.

If at least one of the glossy images VG includes plural silver toner images VT, one of the glossy images VG including a silver toner image VT having the highest dot percent is first transferred and fixed to the sheet P.

If the silver toner images VT to be formed on the front surface and the back surface have the same dot percent, one of the glossy images VG including a silver toner image VT having a larger area (FIG. 19A) necessarily passes through the fixing unit 34 twice. Thus, in the silver toner image VT having a larger area, the reflective surfaces 110A shown in FIG. 5B become closer to parallel to the sheet surface PA, and the flop index is improved.

If at least one of the glossy images VG includes plural silver toner images VT, one of the glossy images VG including silver toner images VT the sum of the areas of which is larger (the total area of the silver toner images VT is larger) is first transferred and fixed to the sheet P.

If the silver toner images VT to be formed on both surfaces have the same dot percent and the same area, either of the silver toner images VT may pass through the fixing unit 34 twice.

Modification of Control of Gloss Mode

Next, an example of modification of control of the gloss mode will be described.

Forming Glossy Images on Both Surfaces

Figure 13:
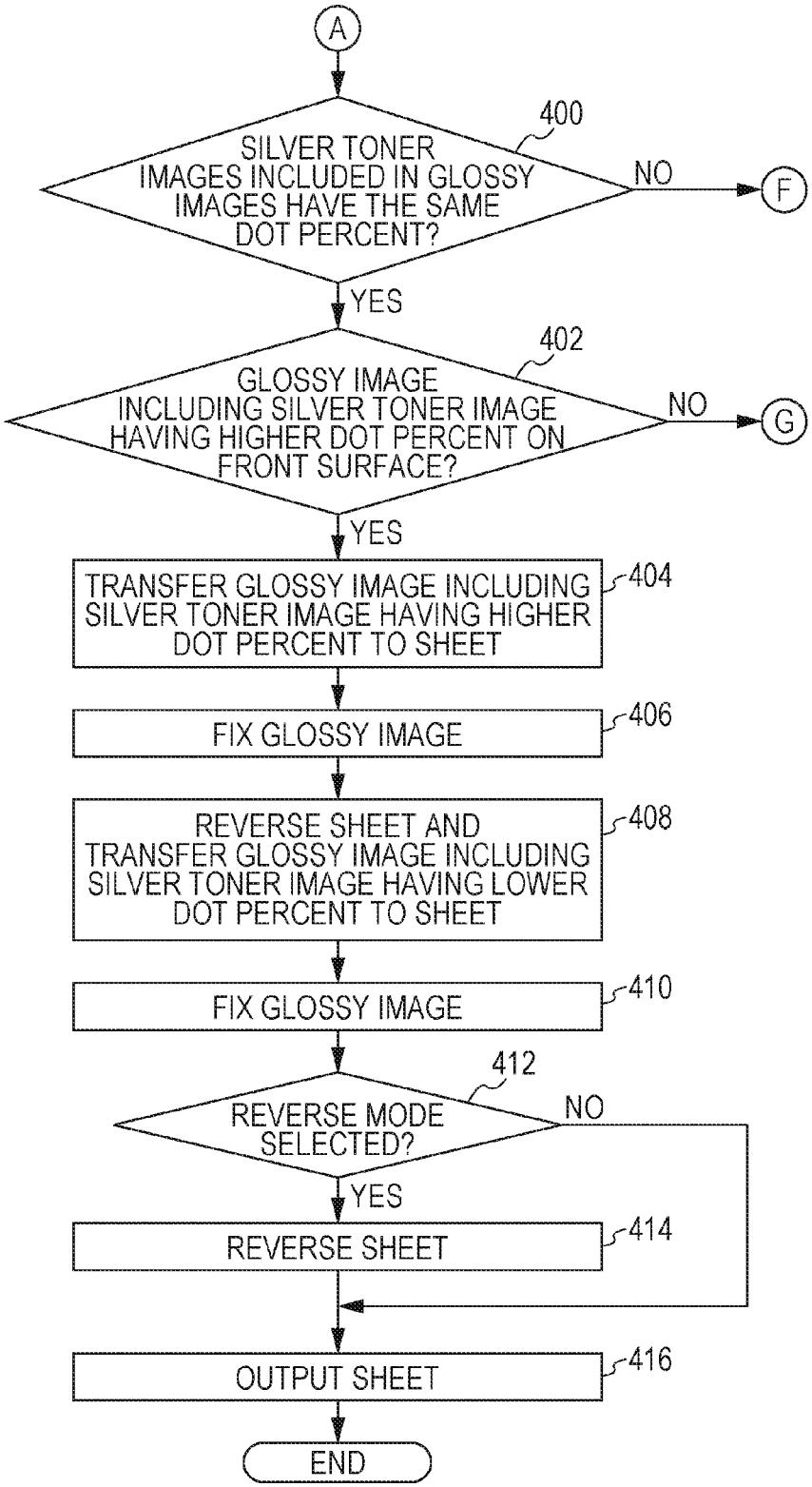
FIG. 13 is a flowchart of a process through which an image forming apparatus according to a modification forms glossy images on both surfaces of a sheet when a gloss mode is selected.

If it is determined in step 200 that glossy images VG are to be formed on both surfaces, the process proceeds to step 400 shown in FIG. 13.

Figure 15:
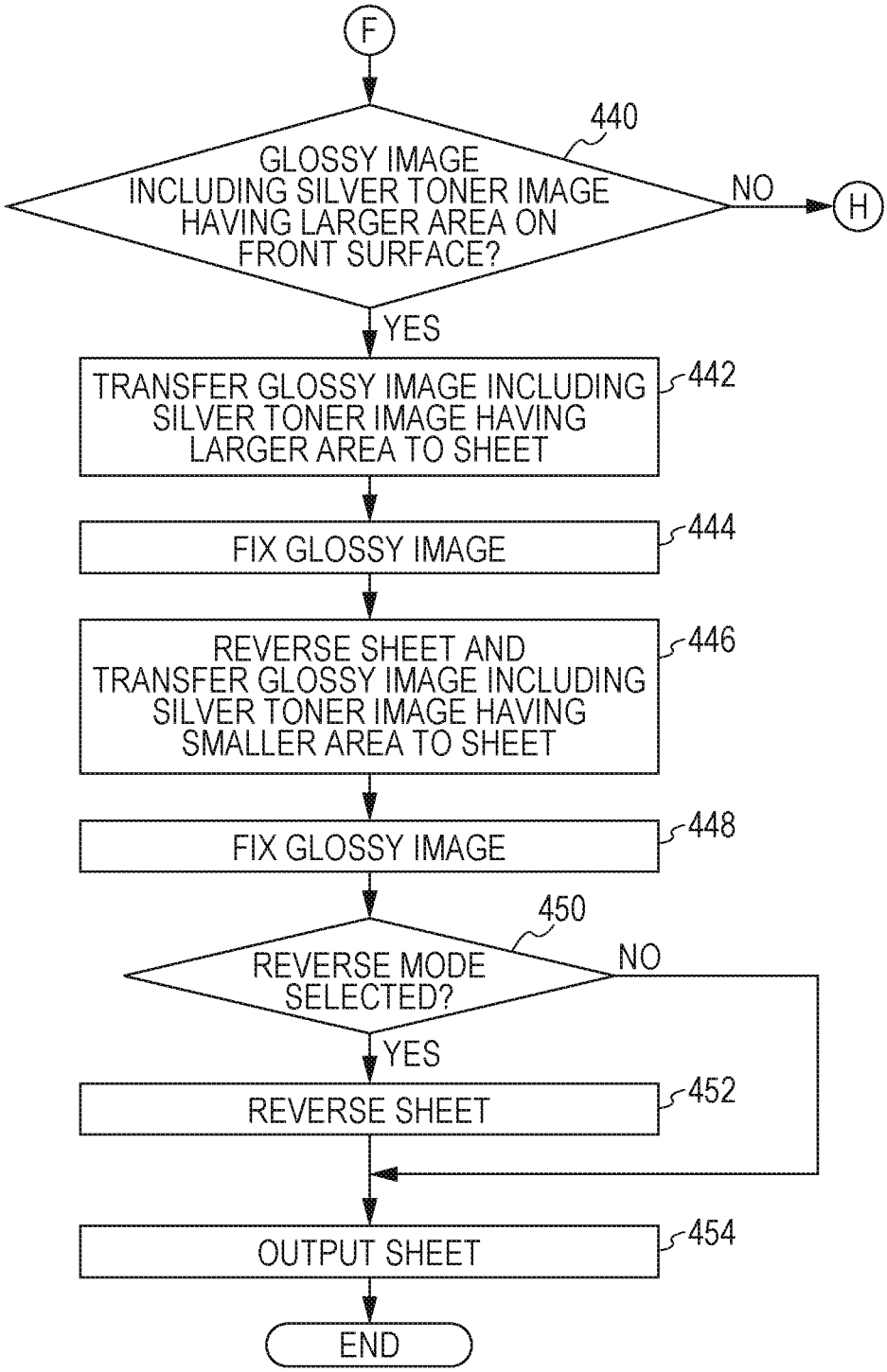
FIG. 15 is a flowchart of a process through which the image forming apparatus according to the modification forms glossy images on both surfaces of a sheet when a gloss mode is selected.

Forming Glossy Images VG Including Silver Toner Images VT Having Different Dot Percent Referring to FIG. 13, in step 400, on the basis of job data, the controller determines whether or not silver toner images VT included in glossy images VG have the same dot percent. If the dot percent are the same, the process proceeds to step 440 (FIG. 15). If not, the process proceeds to step 402.

Figure 14:
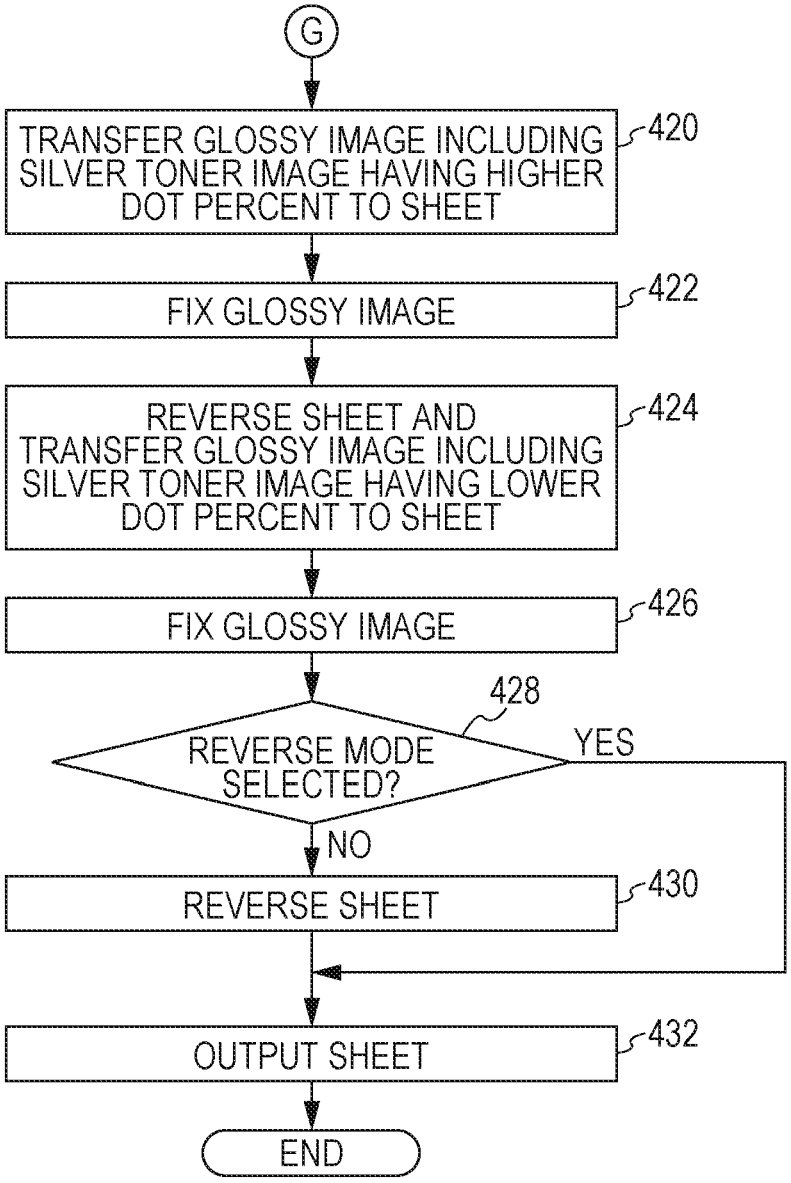
FIG. 14 is a flowchart of a process through which the image forming apparatus according to the modification forms glossy images on both surfaces of a sheet when a gloss mode is selected.

In step 402 shown in FIG. 13, on the basis of job data, the controller 70 determines whether or not a glossy image VG including a silver toner image VT having a higher dot percent (FIG. 20A) is to be formed on the front surface. If the glossy image VG including a silver toner image VT having a higher dot percent is to be formed on the front surface, the process proceeds to step 404. If the glossy image VG is to be formed on the back surface, the process proceeds to step 420 (FIG. 14).

Forming Silver Toner Image Having Higher Dot Percent on Front Surface

In step 404, a glossy image VG including a silver toner image VT having a higher dot percent (FIG. 20A) is transferred to the sheet P, and the process proceeds to step 406. In step 404, the glossy image VG (FIG. 20A) is fixed to the sheet P by the fixing unit 34 (FIGS. 1 and 2), and the process proceeds to step 408.

In step 408, the sheet P is reversed in the reverse path 26, a glossy image VG (FIG. 20B) including a silver toner image VT having a lower dot percent is transferred to the sheet P, and the process proceeds to step 410. In step 410, the glossy image VG (FIG. 20B) is fixed to the sheet P by the fixing unit 34, and the process proceeds to step 412.

In step 412, on the basis of job data, the controller 70 determines whether or not the reverse mode is selected.

If the reverse mode is selected, the process proceeds to step 414. As illustrated in FIGS. 4A to 4C, the sheet P is reversed, the process proceeds to step 416, and the sheet P is output so that a surface on which the glossy image VG including a silver toner image VT having a higher dot percent (FIG. 20A) is formed faces upward.

If the reverse mode is not selected, the process proceeds to step 416, and the sheet P is output so that a surface on which the glossy image VG including a silver toner image VT having a lower dot percent (FIG. 20B) is formed faces upward.

Forming Silver Toner Image Having Higher Dot Percent on Back Surface

As described above, if it is determined in step 402 that the glossy image VG including a silver toner image VT having a higher dot percent is not to be formed on the front surface (but is to be formed on the back surface), the process proceeds to step 420 shown in FIG. 14.

In step 420, the order of forming the glossy image VG including a silver toner image VT having a lower dot percent (as shown in FIG. 20B) and the glossy image VG including a silver toner image VT having a higher dot percent (as shown in FIG. 20A) is switched. The glossy image VG including a silver toner image VT having a higher dot percent (FIG. 20A) is first transferred to the sheet P, and the process proceeds to step 422. In step 422, the glossy image VG (FIG. 20A) is fixed to the sheet P by the fixing unit 34 (FIGS. 1 and 2), and the process proceeds to step 424.

In step 424, the sheet P is reversed in the reverse path 26, the glossy image VG including a silver toner image VT having a lower dot percent (FIG. 20B) is transferred to the sheet P, and the process proceeds to step 426. In step 426, the glossy image VG (FIG. 20B) is fixed to the sheet P by the fixing unit 34, and the process proceeds to step 428.

In step 428, on the basis of job data, the controller 70 determines whether or not the reverse mode is selected.

If a user has selected the reverse mode, the user recognizes that the glossy image VG (FIG. 20B) including a silver toner image VT having a lower dot percent is formed on the front surface, and the user wants the sheet P to be output so that a surface on which the glossy image VG (FIG. 20B) is formed faces upward. If the user has not selected the reverse mode, the user wants that the sheet P is output so that a surface on which the glossy image VG including a silver toner image VT having a higher dot percent (FIG. 20A) is formed faces upward.

Thus, if the reverse mode is selected, the process proceeds to step 432, the sheet P is not reversed, and the sheet P is output so that a surface on which the glossy image VG including a silver toner image VT having a lower dot percent (FIG. 20B) is formed faces upward.

If the reverse mode is not selected, the process proceeds to step 430. As illustrated in FIGS. 4A to 4C, the sheet P is transported into the branch path 26P1 of the reverse path 26 to change the transport direction and transported through the branch reverse path 26P4, and the sheet P is output so that a surface on which the glossy image VG including a silver toner image VT having a higher dot percent (FIG. 20A) is formed faces upward.

Forming Glossy Images VG Including Silver Toner Images VT Having the Same Dot Percent As described above, if it is determined in step 400 shown in FIG. 13 that silver toner images VT included in glossy images VG have the same dot percent, the process proceeds to step 440 shown in FIG. 15.

Forming Silver Toner Image Having Larger Area on Front Surface

Figure 16:
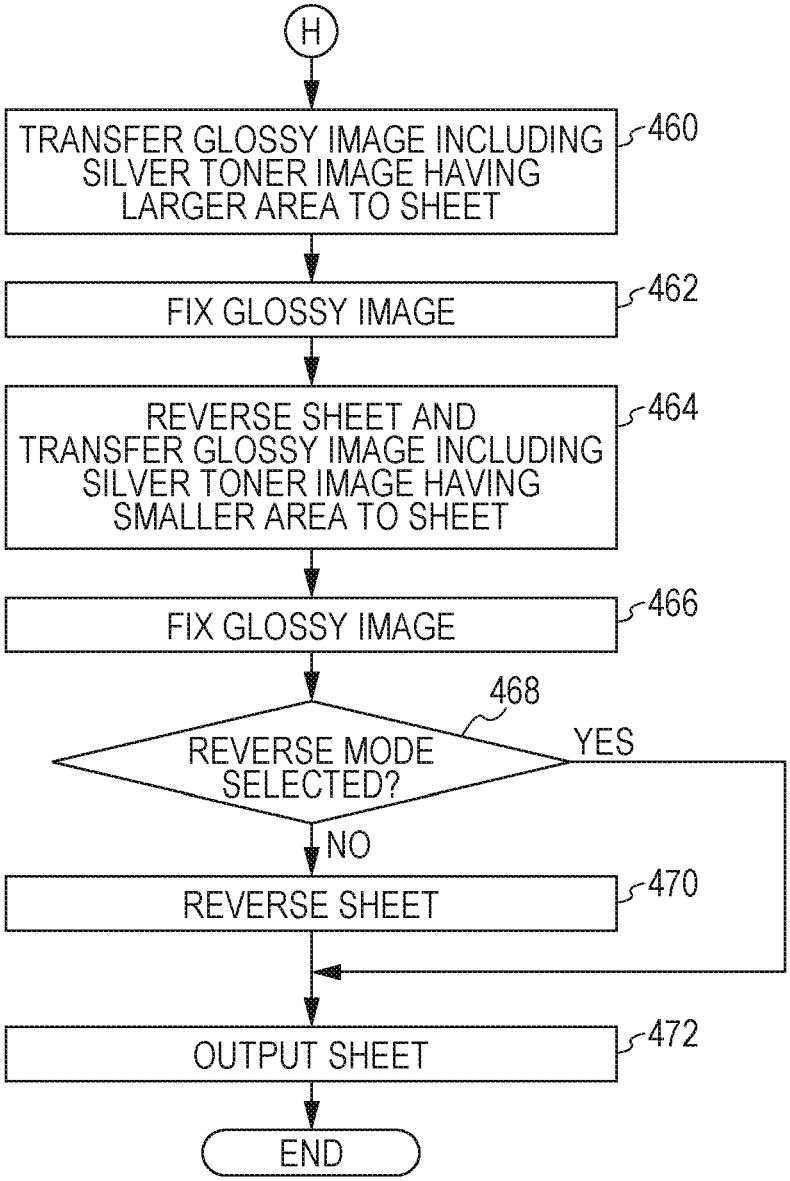
FIG. 16 is a flowchart of a process through which the image forming apparatus according to the modification forms glossy images on both surfaces of a sheet when a gloss mode is selected.

Referring to FIG. 15, in step 440, on the basis of job data, the controller 70 determines whether or not a glossy image VG including a silver toner image VT having a larger area is to be formed on the front surface. If the glossy image VG including a silver toner image VT having a larger area (as shown in FIG. 21A) is to be formed on the front surface, the process proceeds to step 442. If the glossy image VG is to be formed on the back surface, the process proceeds to step 460 (FIG. 16).

In step 442, the glossy image VG including a silver toner image VT having a larger area (FIG. 21A) is transferred to the sheet P, and the process proceeds to step 444. In step 444, the glossy image VG (FIG. 21A) is fixed to the sheet P by the fixing unit 34 (FIGS. 1 and 2), and the process proceeds to step 446.

In step 446, the sheet P is reversed in the reverse path 26, and the glossy image VG including a silver toner image VT having a smaller area (FIG. 21B) is transferred to the sheet P, and the process proceeds to step 448. In step 448, the glossy image VG (FIG. 21B) is fixed to the sheet P by the fixing unit 34, and the process proceeds to step 450.

In step 450, on the basis of job data, the controller 70 determines whether or not the reverse mode is selected.

If the reverse mode is selected, the process proceeds to step 452. As illustrated in FIGS. 4A to 4C, the sheet P is reversed, the process proceeds to step 454, and the sheet P is output so that the front surface, on which the glossy image VG including a silver toner image VT having a larger area (FIG. 21A) is formed, faces upward.

If the reverse mode is not selected, the process proceeds to step 454, and the sheet P is output so that a surface on which the glossy image VG including a silver toner image VT having a smaller area (FIG. 21B) is formed faces upward.

Forming Silver Toner Image Having Larger Area on Back Surface

As described above, if it is determined in step 440 that the glossy image VG including a silver toner image VT having a larger area (as shown in FIG. 21A) is not to be formed on the front surface (but is to be formed on the back surface), the process proceeds to step 460 shown in FIG. 16.

In step 460, the order of forming the glossy image VG including a silver toner image VT having a smaller area (as shown in FIG. 21B) and the glossy image VG including a silver toner image VT having a larger area (as shown in FIG. 21A) is switched. The glossy image VG including a silver toner image VT having a larger area (FIG. 21A) is first transferred to the sheet P, and the process proceeds to step 462. In step 462, the glossy image VG (FIG. 21A) is fixed to the sheet P by the fixing unit 34 (FIGS. 1 and 2), and the process proceeds to step 464.

In step 464, the sheet P is reversed in the reverse path 26, the glossy image VG including a silver toner image VT having a smaller area (FIG. 21B) is transferred to the sheet P, and the process proceeds to step 466. In step 466, the glossy image VG (FIG. 21B) is fixed to the sheet P by the fixing unit 34, and the process proceeds to step 468.

In step 468, on the basis of job data, the controller 70 determines whether or not the reverse mode is selected.

A user recognizes that the glossy image VG including a silver toner image VT having a smaller area (FIG. 21B) is formed on the front surface, and, if the user has selected the reverse mode, the user wants the sheet P to be output so that the front surface, on which the glossy image VG including a silver toner image VT having a smaller area (FIG. 21B) is formed, faces upward. If the user has not selected the reverse mode, the user wants the sheet P to be output so that a surface on which the glossy image VG including a silver toner image VT having a larger area (FIG. 21A) is formed faces upward.

Thus, if the reverse mode is selected, the process proceeds to step 472, the sheet P is not reversed, and the sheet P is output so that a surface on which the glossy image VG including a silver toner image VT having a smaller area (FIG. 21B) is formed faces upward.

If the reverse mode is not selected, the process proceeds to step 470. As illustrated in FIGS. 4A to 4C, the sheet P is reversed, the process proceeds to step 472, and the sheet P is output so that a surface on which the glossy image VG including a silver toner image VT having a larger area (FIG. 21A) is formed faces upward.

If the silver toner images VT to be formed on both surfaces have the same dot percent (Cin) and have the area, the controller 70 may perform control in the same way as in existing technologies.

Others

The present invention is not limited to the exemplary embodiment described above.

For example, in the exemplary embodiment described above, the gloss mode is selectable. However, this is not a limitation. Without allowing the selection, the controller 70 may perform control so that printing is performed in the gloss mode.

For example, in the exemplary embodiment described above, the reverse mode is selectable. However, this is not a limitation. The image forming apparatus 10 need not have the reverse mode.

When forming glossy images VG on both surfaces, control may be performed in a way different from the exemplary embodiment as follows. Control may be performed so that the amount of the metallic pigment 110 in which the reflective surfaces 110A extend substantially parallel to the sheet surface PA is increased. Alternatively, control may be performed so that the amount of the metallic pigment 110 that passes the fixing unit 34 twice is increased.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit configured to form a first image and a second image and to transfer the first image and the second image to a recording medium, the first image including a metallic color toner and a flat metallic pigment thereof, the second image not including the metallic color toner;

a fixing unit configured to fix the first image and the second image to opposite ones of a first surface and a second surface of the recording medium by heating the first image and the second image; and a controller configured to change an order of fixing the first image and the second image to the opposite ones of the first surface and the second surface such that the first image is fixed before the second image is fixed in a case that job data indicates that the second image is to be fixed before the first image is fixed.

2. The image forming apparatus according to claim 1, wherein the image forming apparatus has a mode in which whether to output the recording medium so that the first surface faces upward or to output the recording medium so that the second surface faces upward is selectable.

3. The image forming apparatus according to claim 1, further comprising an output unit configured to output the recording medium, wherein the output unit is further configured to output the first image facing up in a first case, the output unit is further configured to output the first image facing down in a second case, and in both of the first case and the second case, the first image is transferred to the recording medium prior to the second image being transferred to the recording medium.

4. The image forming apparatus according to claim 1, wherein the controller is configured to change the order in response to receiving the job data.

5. The image forming apparatus according to claim 1, wherein the order is indicated by the job data, and wherein the order is input by a user.

6. An image forming apparatus comprising:

an image forming unit configured to form an image and to transfer the image to a recording medium, the image including a metallic color image formed by using a metallic color toner including a flat metallic pigment; and a fixing unit configured to fix the image, which has been transferred to the recording medium, to the recording medium by heating the image, wherein the image forming apparatus has a mode in which, in a case of forming the image including the metallic color image on each of a first surface and a second surface of the recording medium, the image forming unit transfers one of the images including one of the metallic color images having a larger area to the first surface of the recording medium and the fixing unit fixes the one of the images to the first surface, and subsequently the image forming unit transfers the other image including the other metallic color image having a smaller area to the second surface of the recording medium and the fixing unit fixes the other image to the second surface.

7. The image forming apparatus according to claim 6, wherein, the image forming unit is further configured, in response to a determination that the metallic color images to be formed on the first surface and the second surface of the recording medium have the same area, to transfer one of the images including one of the metallic color images having a higher dot percent to the first surface of the recording medium.

8. The image forming apparatus according to claim 7, wherein the image forming apparatus has a mode in which whether to output the recording medium so that the first surface faces upward or to output the recording medium so that the second surface faces upward is selectable.

9. The image forming apparatus according to claim 6, wherein the image forming apparatus has a mode in which whether to output the recording medium so that the first surface faces upward or to output the recording medium so that the second surface faces upward is selectable.

10. An image forming apparatus comprising:

an image forming unit configured to form an image and transfers the image to a recording medium, the image including a metallic color image formed by using a metallic color toner including a flat metallic pigment; and a fixing unit configured to fix the image, which has been transferred to the recording medium, to the recording medium by heating the image, wherein the image forming apparatus has a mode in which, in a case of forming the image including the metallic color image on each of a first surface and a second surface of the recording medium, the image forming unit transfers one of the images including one of the metallic color images having a higher dot percent to the first surface of the recording medium and the fixing unit fixes the one of the images to the first surface, and subsequently the image forming unit transfers the other image including the other metallic color image having a lower dot percent to the second surface of the recording medium and the fixing unit fixes the other image to the second surface.

11. The image forming apparatus according to claim 10, wherein, the image forming unit is further configured, in response to a determination that the metallic color images to be formed on the first surface and the second surface of the recording medium have the same dot percent, to transfer one of the images including one of the metallic color images having a larger area to the first surface of the recording medium.

12. The image forming apparatus according to claim 11, wherein the image forming apparatus has a mode in which whether to output the recording medium so that the first surface faces upward or to output the recording medium so that the second surface faces upward is selectable.

13. The image forming apparatus according to claim 10, wherein the image forming apparatus has a mode in which whether to output the recording medium so that the first surface faces upward or to output the recording medium so that the second surface faces upward is selectable.

* * * * *